US011569641B2

(12) United States Patent
Willden et al.

(10) Patent No.: US 11,569,641 B2
(45) Date of Patent: Jan. 31, 2023

(54) IONIZER BAR

(71) Applicant: NRD LLC, Grand Island, NY (US)

(72) Inventors: Jeremy Paul Willden, Pleasant Grove, UT (US); Helaman David Pratt Ferguson, Orem, UT (US); Martin Robert Johnson, Draper, UT (US); Samuel Tremain Earl, Glendale, AZ (US); Lawrence Bruce Levit, Alamo, CA (US); Jonathan Scott Jensen, Pocatello, ID (US); John M. Glynn, II, Burlington, MA (US)

(73) Assignee: NRD LLC, Grand Island, NY (US)

( * ) Notice: Subject to any disclaimer, the term of this patent is extended or adjusted under 35 U.S.C. 154(b) by 146 days.

(21) Appl. No.: 17/098,833

(22) Filed: Nov. 16, 2020

(65) Prior Publication Data

US 2022/0158419 A1 May 19, 2022

(51) Int. Cl.
*H01T 23/00* (2006.01)
*H01J 49/10* (2006.01)

(52) U.S. Cl.
CPC ..... *H01T 23/00* (2013.01); *H01J 49/10* (2013.01)

(58) Field of Classification Search
None
See application file for complete search history.

(56) References Cited

U.S. PATENT DOCUMENTS

| | | | | |
|---|---|---|---|---|
| 4,156,364 | A * | 5/1979 | Hill | G01F 1/64 73/504.06 |
| 4,423,462 | A | 12/1983 | Antonevich | |
| 4,878,149 | A | 10/1989 | Stiehl et al. | |
| 5,047,892 | A | 9/1991 | Sakata et al. | |
| 5,057,966 | A | 10/1991 | Sakata et al. | |
| 6,252,233 | B1 | 6/2001 | Good | |
| 6,826,030 | B2 | 11/2004 | Gorczyca et al. | |
| 8,009,405 | B2 | 8/2011 | Gefter et al. | |
| 8,073,365 | B2 | 12/2011 | Adachi et al. | |
| 8,773,837 | B2 | 7/2014 | Partridge et al. | |
| 9,006,678 | B2 | 4/2015 | Ivashin et al. | |
| 9,084,334 | B1 | 7/2015 | Getter et al. | |
| D743,017 | S | 11/2015 | Klochkov et al. | |
| 9,357,624 | B1 | 5/2016 | Getter et al. | |
| 9,380,689 | B2 | 6/2016 | Getter et al. | |
| 9,642,232 | B2 | 5/2017 | Getter et al. | |
| 10,136,507 | B2 | 11/2018 | Getter et al. | |
| 2004/0025497 | A1 * | 2/2004 | Truce | B03C 3/41 60/275 |
| 2005/0270722 | A1 * | 12/2005 | Gorczyca | H01T 23/00 361/230 |
| 2016/0196949 | A1 | 7/2016 | Watkins et al. | |

FOREIGN PATENT DOCUMENTS

| | | |
|---|---|---|
| JP | H11150082 | 6/1999 |

* cited by examiner

*Primary Examiner* — Stephen W Jackson
(74) *Attorney, Agent, or Firm* — Simpson & Simpson, PLLC

(57) ABSTRACT

An alpha ion emitter apparatus, including a circuit, a fluid duct including one or more apertures, and a rail electrically connected to the circuit and operatively arranged to hold an alpha ionization material that emits alpha particles, the alpha particles creating alpha ions, wherein the circuit is operatively arranged to apply an output signal to at least one of the fluid duct and the rail.

17 Claims, 20 Drawing Sheets

IONIZER BAR

FIELD

The present disclosure relates to alpha ionizers, and, more particularly, to a bar-type alpha ionizer utilizing alpha particles as an ion source with ion motion created by both electrostatic fields and airflow.

BACKGROUND

Air ionizers are often used in places where work is done involving static-electricity-sensitive electronic components, to eliminate the build-up of static charges on non-conductors and insulated conducting objects, and preventing static cling and electrostatic discharge events. As those elements are very sensitive to electricity, they cannot be grounded because the rapid discharge will destroy them as well. Usually, the work is done over a special dissipative table mat, which allows a very slow discharge, and under the air gush of an ionizer. For example, clean rooms having expensive and sensitive machines therein often require ionizers to neutralize static charge or reduce dust therein. In another example, ionizers may be used in environments containing explosive gases or powders.

Known ionizers must be arranged in very close proximity to the work surface since alpha ions cannot be projected a great distance. Specifically, alpha technology does not deliver ions over a long enough distance to be practical for many applications. Known pulsed direct current (DC) ionizers allow ions to travel further before recombining and thus allows a larger area to be kept neutral; however, such pulsed DC ionizers generate extremely high swing voltages on the objects they are designed to discharge. The pulsed DC ionization process alternately produces positive ions followed by negative ions, inducing positive followed by negative voltages on the neutralized area, reducing the effectiveness of the ion-induced neutralization.

Thus, there is a long-felt need for an alpha ionizer that can deliver alpha ions to a work surface from a long distance to provide an increased neutral area and that requires low swing voltages.

SUMMARY

According to aspects illustrated herein, there is provided an alpha ion emitter apparatus, comprising a circuit, a fluid duct including one or more apertures, and a rail electrically connected to the circuit and operatively arranged to hold an alpha ionization material that emits alpha particles, the alpha particles creating alpha ions, wherein the circuit is operatively arranged to apply an output signal to at least one of the fluid duct and the rail.

According to aspects illustrated herein, there is provided a method of producing alpha particles using an alpha ion emitter apparatus, the alpha ion emitter apparatus comprising a circuit, a fluid duct including one or more apertures, and a rail including an alpha ionization material, the method comprising emitting, using the alpha ionization material, a plurality of alpha particles, producing, using the alpha particles, a plurality of alpha ions, applying, using the circuit, a sinusoidal output signal to at least one of the fluid duct and the rail, and repelling, using the at least one of the fluid duct and the rail, the plurality of alpha ions in a first direction.

According to aspects illustrated herein, there is provided an ion emitter apparatus, comprising an ion generator operatively arranged to emit ions, at least one conductor, and a circuit operatively arranged to apply an output signal to the at least one conductor and repel the ions.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring,"

"immediate," "adjoining," etc., and such terms may be used interchangeably as appearing in the specification and claims. The term "approximately" is intended to mean values within ten percent of the specified value.

Figure 1:
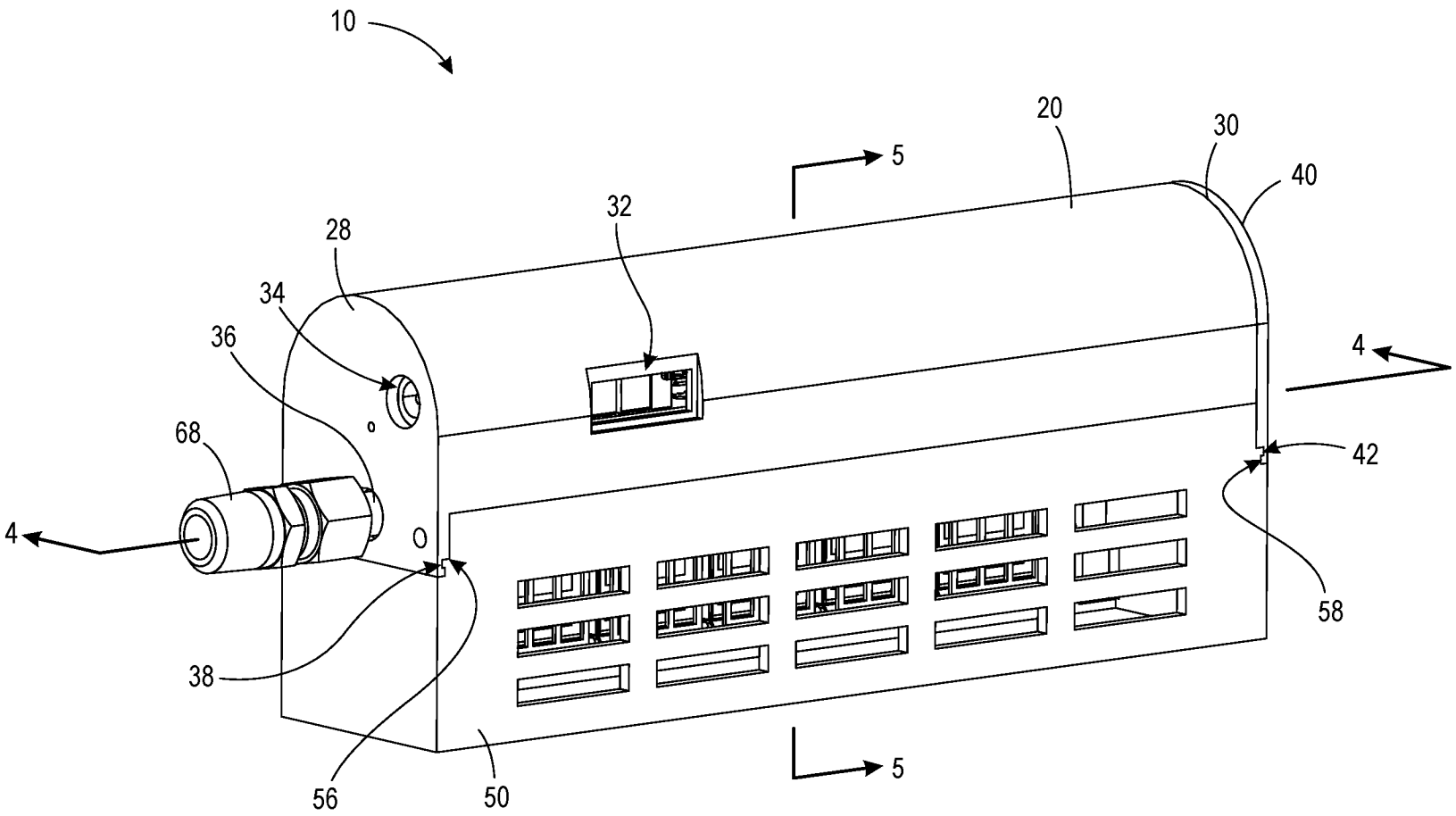
FIG. 1 is a top perspective view of an alpha ion emitter apparatus.
Figure 2:
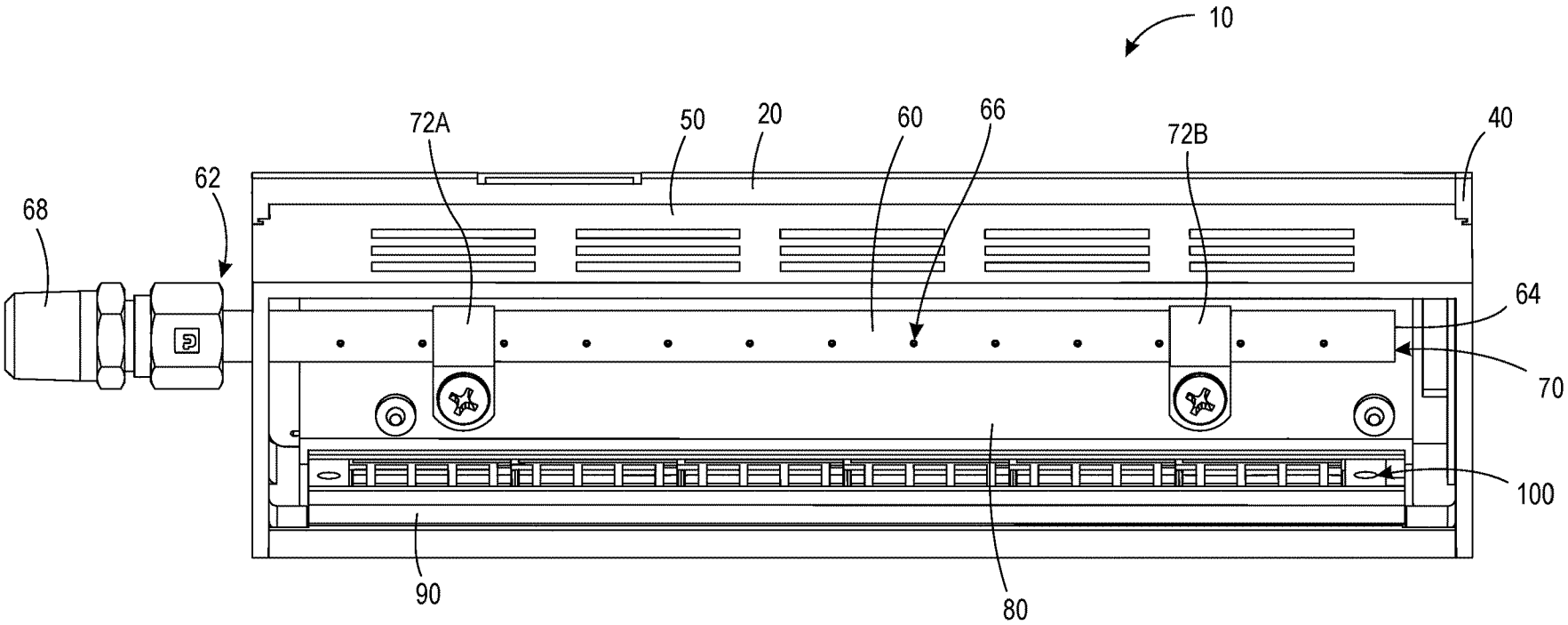
FIG. 2 is a bottom perspective view of the alpha ion emitter apparatus, as shown in FIG. 1.
Figure 3:
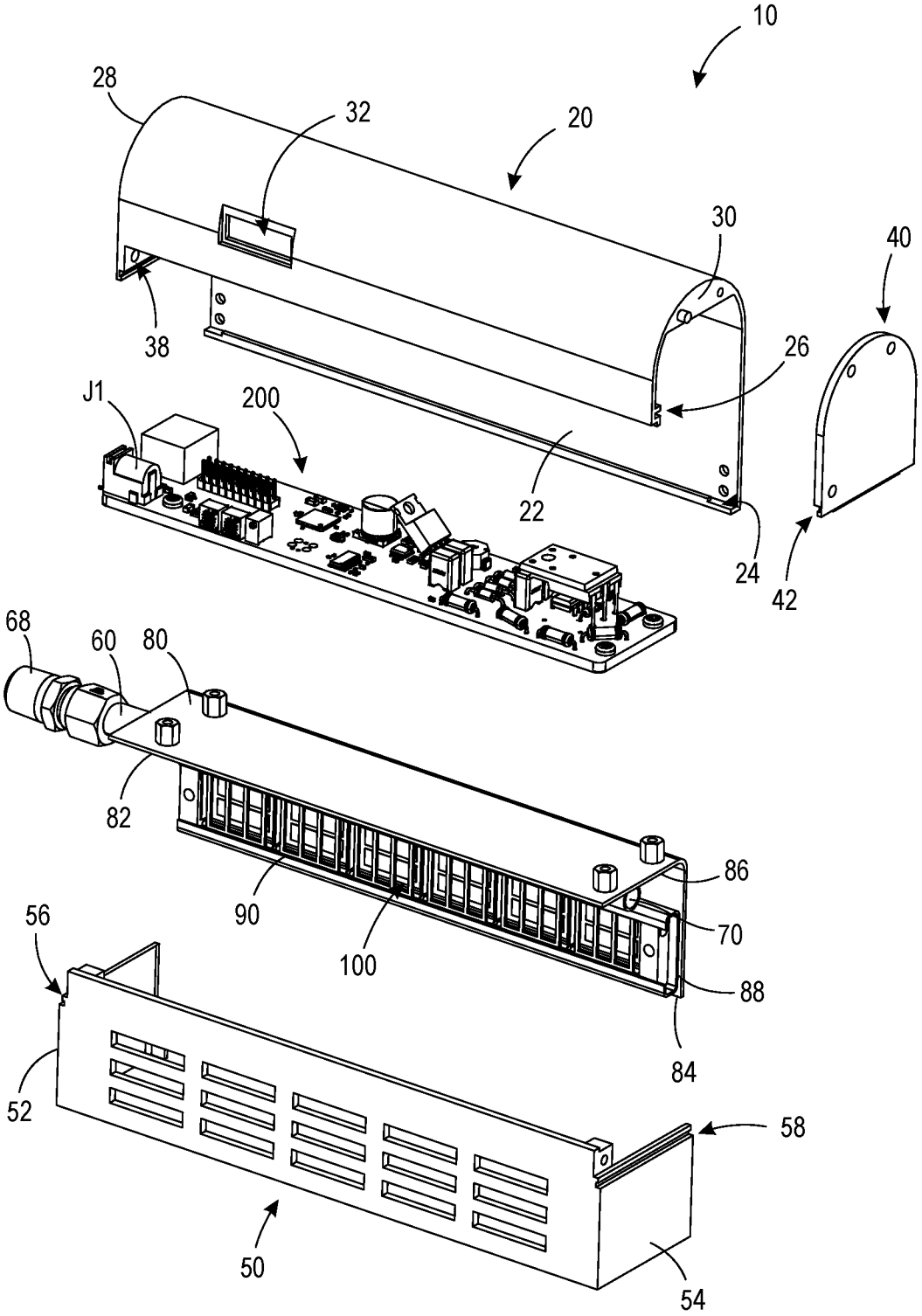
FIG. 3 is a partial exploded perspective view of the alpha ion emitter apparatus shown in FIG. 1.
Figure 4:
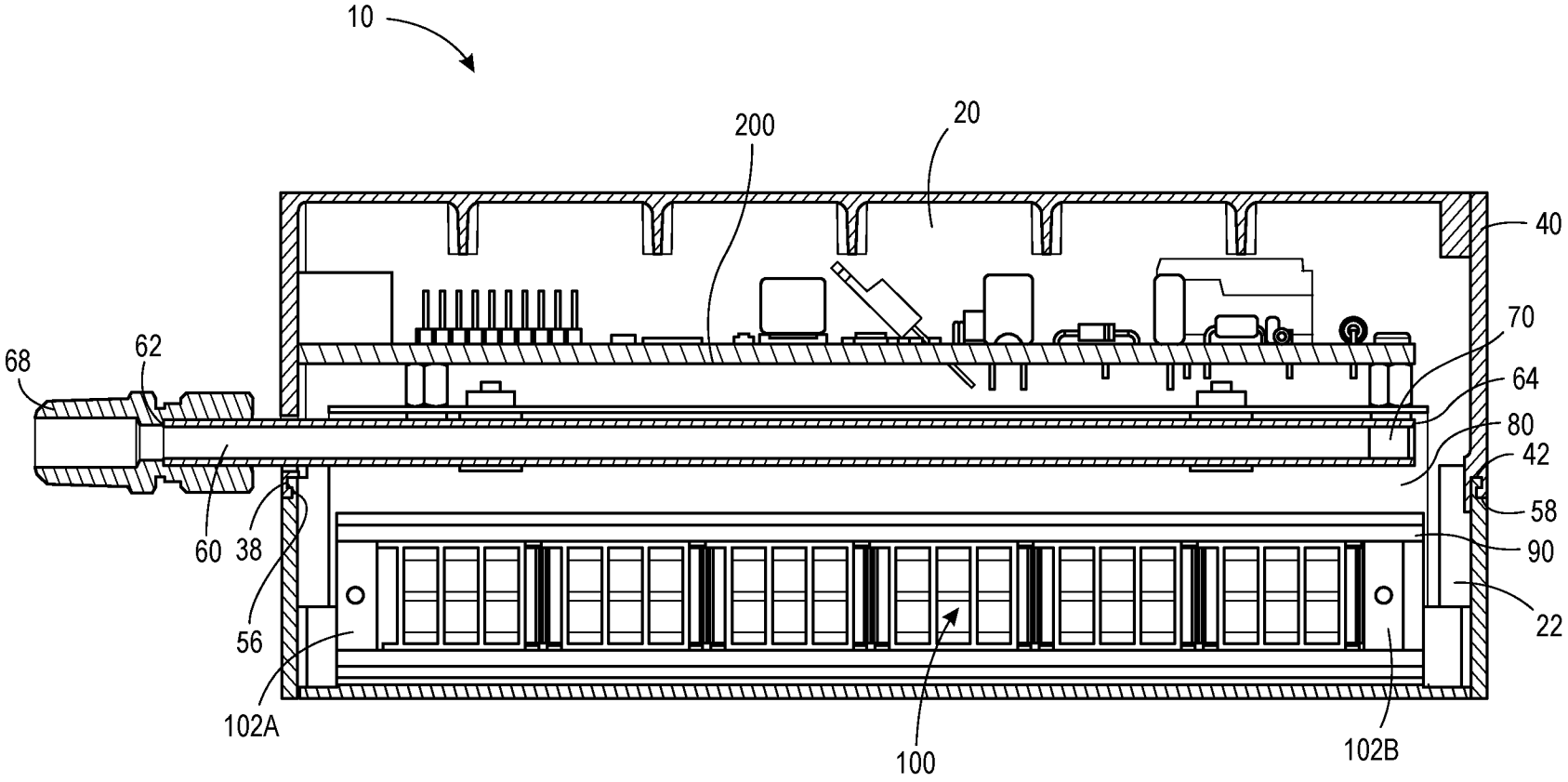
FIG. 4 is a cross-sectional view of the alpha ion emitter apparatus taken generally along line 4-4 in FIG. 1.
Figure 5:
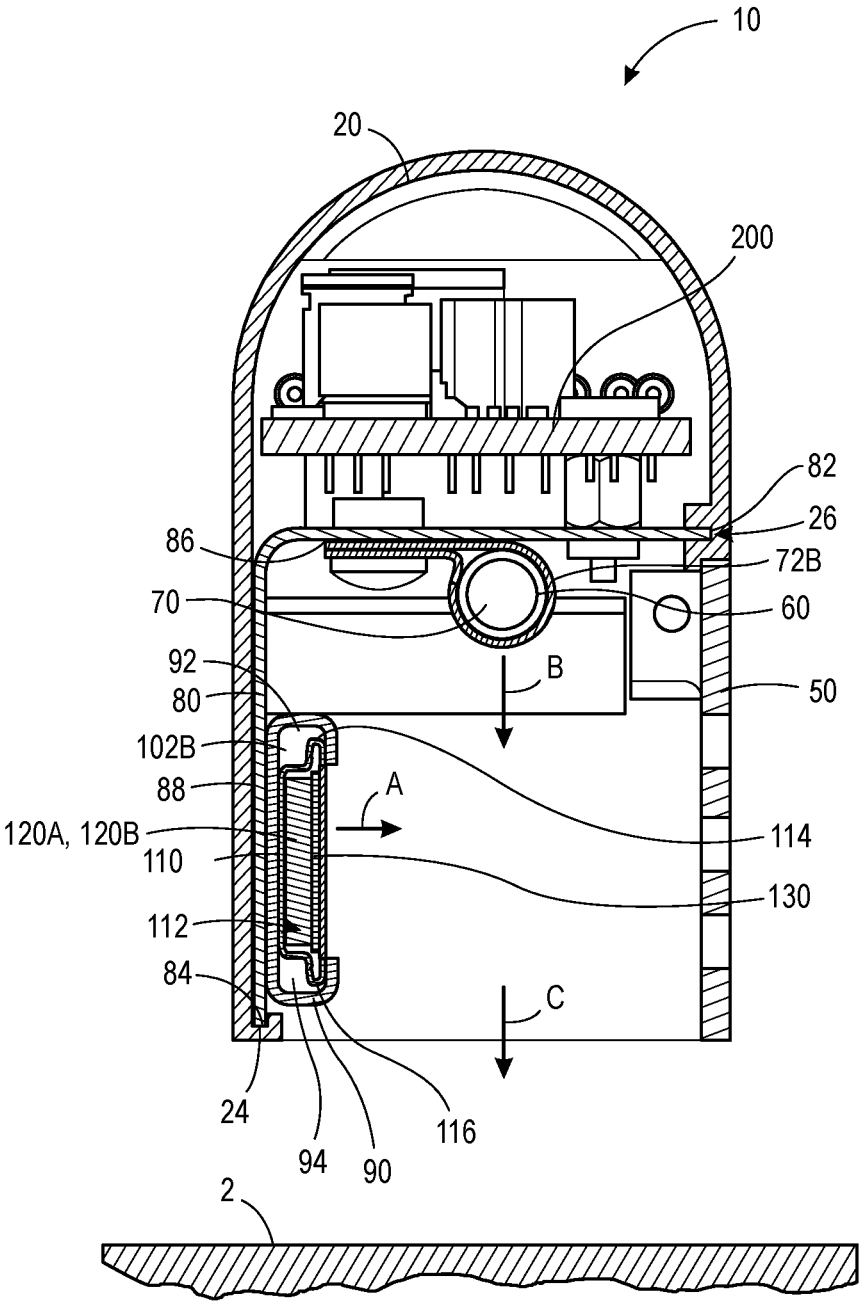
FIG. 5 is a cross-sectional view of the alpha ion emitter apparatus taken generally along line 5-5 in FIG. 1.
Figure 6:
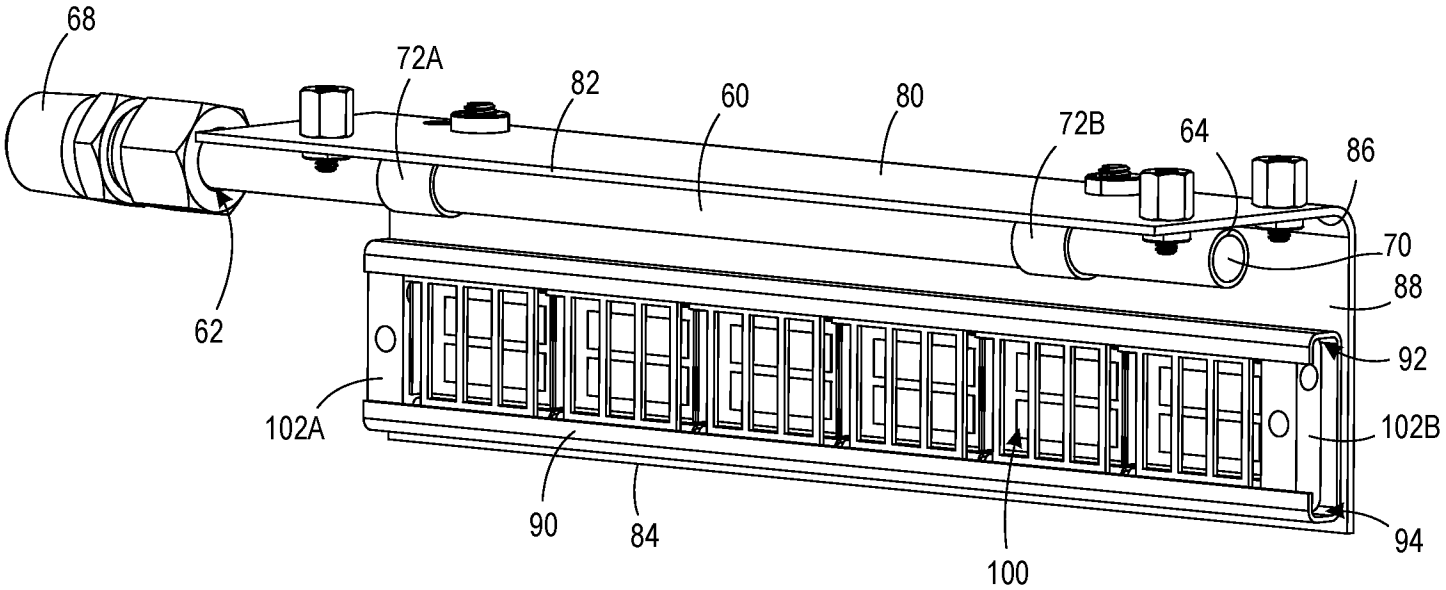
FIG. 6 is a perspective view of the alpha ion emitter apparatus shown in FIG. 1, with the housing, the guard, and the circuit removed.

Adverting now to the figures, FIG. 1 is a top perspective view of alpha ion emitter apparatus 10. FIG. 2 is a bottom perspective view of alpha ion emitter apparatus 10. FIG. 3 is a partial exploded perspective view of alpha ion emitter apparatus 10. FIG. 4 is a cross-sectional view of alpha ion emitter apparatus 10 taken generally along line 4-4 in FIG. 1. FIG. 5 is a cross-sectional view of alpha ion emitter apparatus 10 taken generally along line 5-5 in FIG. 1. FIG. 6 is a perspective view of alpha ion emitter apparatus 10 with housing 20, guard 50, and circuit 200 removed. Alpha ion emitter apparatus 10 generally comprises housing 20, guard 50, fluid duct 60, bracket 80, tray 90, rail 100, and circuit 200. The following description should be read in view of FIGS. 1-6.

Housing 20 comprises surface 22, groove 24, groove 26, end 28, end 30, channel 38, and end plate 40. End plate 40 is removably connected to end 30 and comprises channel 42. End 28 comprises channel 38. Channels 38 and 42 are operatively arranged to engage channels 56 and 58 of guard, respectively. Groove 24 is operatively arranged to engage edge 84 of bracket 80. Groove 26 is operatively arranged to engage edge 82 of bracket 80. Housing 20 is arranged to secure and protect the various internal ionizing components, for example, fluid duct 60, rail 100, and circuit 200. End 28 further comprises hole 34 for a power input and hole 36 for gas input. Specifically, hole 34 allows an for an electrical connection with circuit 200 and hole 36 allows fluid duct 60 to enter housing 20. In some embodiments, housing 20 comprises window 32 operatively arranged to allow access to one or more controls of circuit 200, as will be discussed in greater detail below. It should be appreciated that end plate 40 may be connected to end 30 using any suitable means, for example, screws, bolts, rivets, adhesives, welding, soldering, etc. In some embodiments, housing 20 comprises metal, for example, stainless steel. In some embodiments, housing 20 comprises a non-conductive material, for example, a plastic.

Guard 50 comprises end 52 and end 54, and is operatively arranged to be connected to housing 20. End 52 comprises channel 56 and end 54 comprises channel 58. As previously mentioned, channels 56 and 58 are arranged to engage channels 38 and 42, respectively. In some embodiments, end plate 40 is connected to end 30 of housing 20. Guard 50 is then connected to housing 20, for example, by sliding channels 56 and 58 into channels 38 and 42, respectively. Once guard 50 is fully engaged with housing 20, screws may be used to fixedly secure guard 50 to housing 20. For example, a screw may pass through a hole in end plate 40 and into a screw receiving hole in end 54, and a screw may pass through a hole in end 28 and into a screw receiving hole in end 52. It should be appreciated that guard 50 may be connected to housing 20 using any suitable means, for example, screws, bolts, rivets, adhesives, welding, soldering, etc. Guard 50 is operatively arranged to shield the ionization material within tray 90 and/or rail 100. Specifically, and as will be discussed in greater detail below, tray 90 may comprise a radioactive isotope, such as Polonium-210. Guard 50 protects the material from any contact, as well as protects users from contacting the material. Additionally, guard 50 helps to prevent any fluid flow from disrupting the ionization stream, as will be discussed in greater detail below. In some embodiments, guard 50 comprises metal, for example, stainless steel. In some embodiments, guard 50 comprises a non-conductive material, for example, a plastic.

Bracket 80 is generally an L-shaped plate and comprises edge 82, which corresponds with surface 86, and edge 84, which corresponds with surface 88. In some embodiments, bracket 80 is V-shaped or U-shaped. Bracket 80 is operatively arranged to be connected to housing 20. Specifically, edges 82 and 84 are operatively arranged to engage grooves 26 and 24, respectively. For example, bracket 80 may be slid into housing 20 from end 30, via engagement of edges 82 and 84 in grooves 26 and 24, respectively. Once fully engaged, end plate 40 is connected to end 30 of housing 20, thereby securing bracket to housing 20. Subsequently, guard 50 is connected to housing 20. In some embodiments, bracket 80 is a conductive material, for example, stainless steel. Bracket 80 is operatively arranged to secure fluid duct 60 and rail 100 within housing 20. Bracket 80 is also operatively arranged to optimally direct ions out of housing 20. It should be appreciated, however, that in some embodiments fluid duct 60 and rail 100 may be directly connected to housing 20 without the need for bracket 80. In some embodiments, bracket 80 and housing 20 are integrally formed.

Fluid duct 60 is generally a tube comprising end 62, end 64, and one or more apertures 66. Fluid duct 60 may comprise connector 68, which is connected to a gas supply. Fluid duct 60 may be sealed at end 64, for example, via plug 70. Gas enters fluid duct 60 at end 62, for example via connector 68 and a gas supply, and is expelled out of fluid duct 60 through apertures 66. Fluid duct 60 may have any cross-sectional geometry to expel gas therefrom, for example, cylindrical, rectangular, square, triangular, ovular, etc. It should be appreciated that, although apertures 66 are shown in a circular geometry, any geometry suitable for expelling gas from fluid duct 60 may be used (e.g., square, rectangular, triangular, ovular, ellipsoidal, etc.). In some embodiments, plug 70 is integrally formed with fluid duct 60. Fluid duct 60 may be connected to bracket 80 via any suitable means, for example, by one or more brackets 72A-B. In some embodiments, fluid duct 60 comprises metal, for example, stainless steel. In some embodiments, fluid duct 60 comprises a non-conductive material, for example, a plastic.

Tray 90 is connected to bracket 80. Tray 90 is operatively arranged to hold rail 100. Tray 90 comprises channel 92 and channel 94. Tray 90 is connected to surface 88 via any suitable means, for example, screws, rivets, bolts, welding, soldering, etc. In some embodiments, tray 90 and bracket 80 are integrally formed. In some embodiments, tray 90 comprises metal, for example, stainless steel. In some embodiments, tray 90 comprises a non-conductive material, for example, a plastic.

Figure 7:
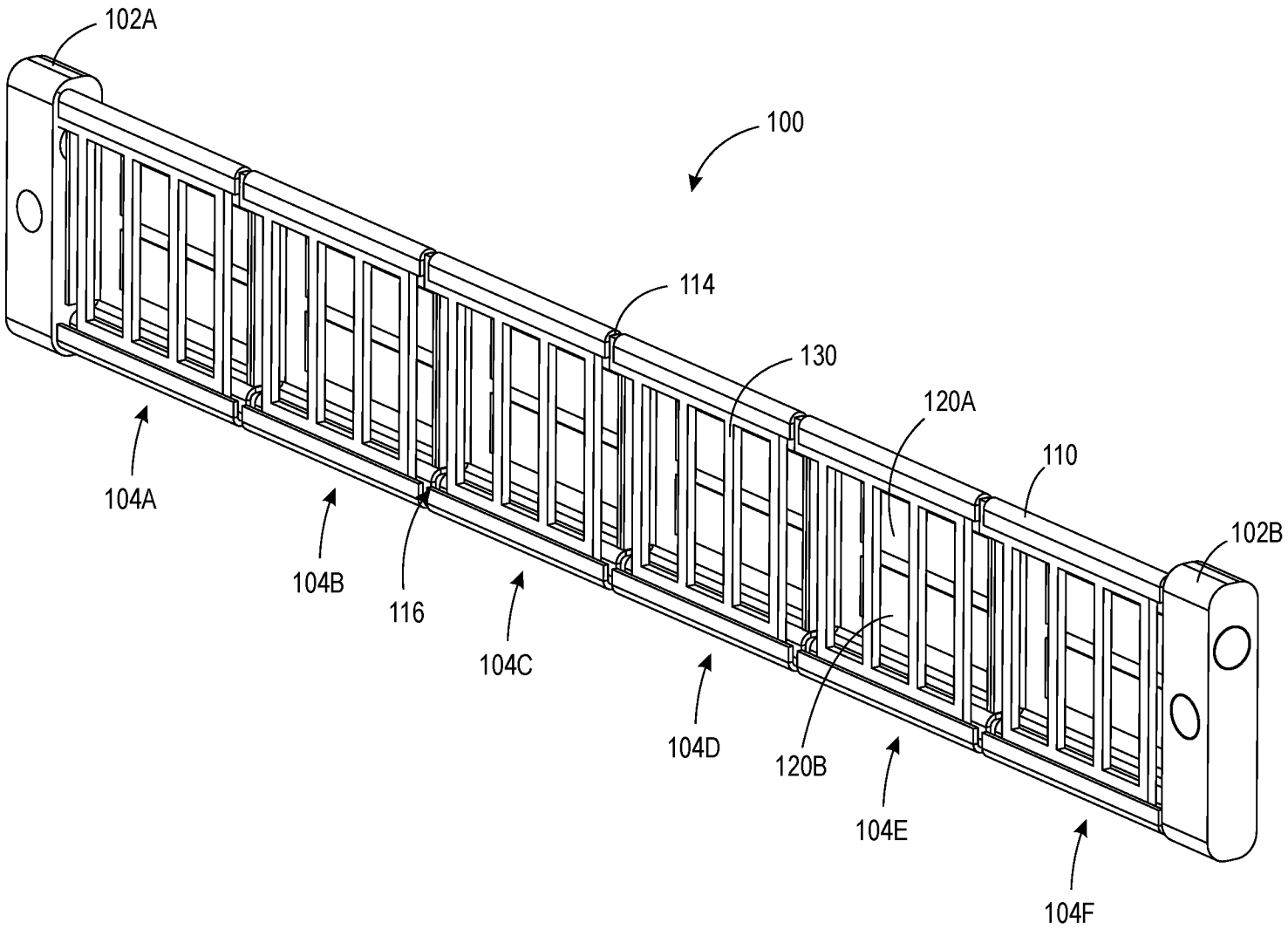
FIG. 7 is a perspective view of a rail of the alpha ion emitter apparatus shown in FIG. 1.
Figure 8:
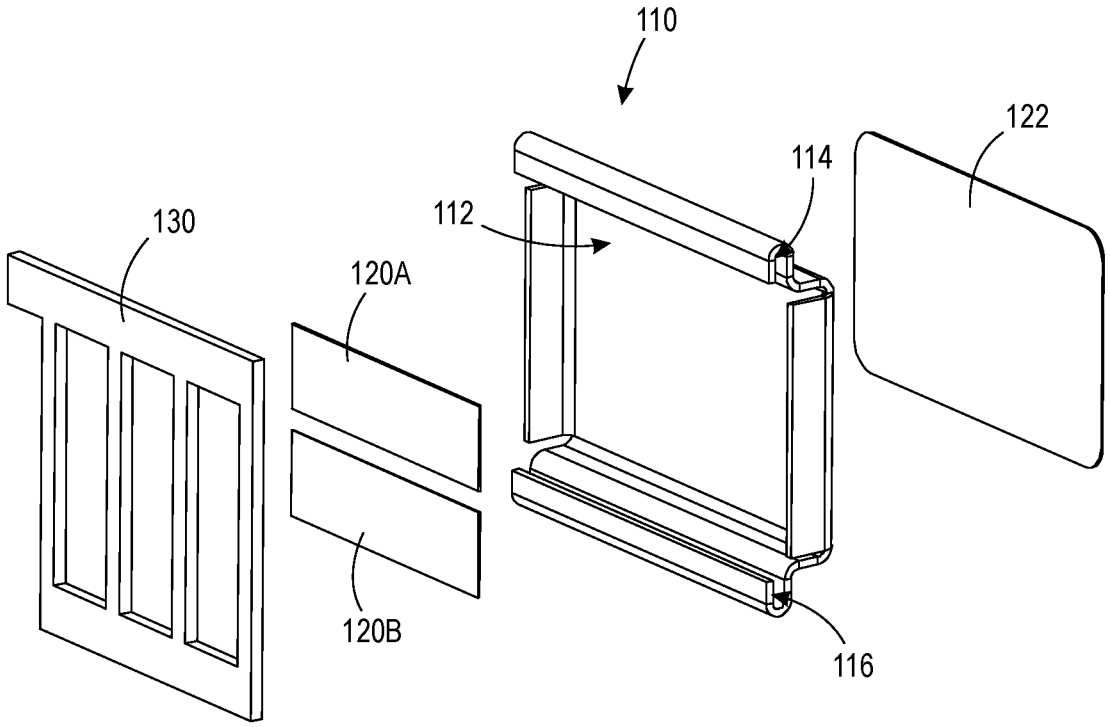
FIG. 8 is an exploded perspective view of a section of the rail shown in FIG. 7.

FIG. 7 is a perspective view of rail 100. FIG. 8 is an exploded perspective view of a section of rail 100. Rail 100 generally comprises at least one tray 110 and one or more foils or ionization material 120A-B. Rail 100 may further comprise at least one grid 130, and one or more end caps 102A-B. The following description should be read in view of FIGS. 7-8.

Tray 110 comprises cavity 112, channel 114, and channel 116. One or more foils 120A-B are arranged in cavity 112. Foils 120A and 120B may comprise an ionization material, for example Polonium-210. In some examples, the ionization material is Americium. In some examples, the ionization material is krypton. In some embodiments, the ionization material is an X-ray generator or similar high energy particle source that is non-radioactive. The ionization material may be any material suitable for generating ions. Grid 130 is operatively arranged to engage tray 110, specifically channels 114 and 116, to maintain foils 120A and 120B within cavity 112. At the same time, grid 130 allows ions emitted from foils 120A and 120B to enter the stream of gas from apertures 66 of fluid duct 60, thereby forcing the ions down toward the work space or target area. Foils 120A and/or 120 are arranged in cavity 112, and grid 130 is subsequently slid into channels 114 and 116. Tray 110 comprises conductive material or metal, for example, stainless steel. In some embodiments, grid 130 comprises a conductive material or metal, for example, stainless steel. In some embodiments, grid 130 comprises a non-conductive material, for example, a plastic. Rail 100 may further comprise label 122. Label 122 may be connected to tray 110 on a side opposite the side of cavity 112. Label 122 may indicate information about the alpha ion emitting material and/or alpha ion emitter apparatus 10.

As shown in FIG. 7, rail 100 may comprise a plurality of sections, for example six sections 104A-F. Each of sections 104-F including tray 110, one or more foils 120A-B, and grid 130. Each of sections 104A-F may further comprise label 122. Sections 104A-F are inserted in tray 90 and enclosed therein by end caps 102A and 102B, as shown in FIG. 6. Specifically, tray 110 is arranged to engage channels 92 and 94 of tray 90. In some embodiments, tray 110 is connected directly to bracket 80 and there is no need for tray 90. In some embodiments, tray 110 is connected directly to housing 20, and there is no need for tray 90 or bracket 80. End caps 102A and 102B may be connected to tray 90 using any means suitable to maintain sections 104A-F within tray 90, for example, bolts, screws, rivets, solder, welding, adhesives, etc.

Rail 100 is operatively arranged to be electrically connected to circuit 200. Specifically, once rail 100 is electrically energized, foils 120A and 120B produce and emit ions. This may be accomplished by electrically connecting circuit 200 to bracket 80, which is electrically connected to tray 90 and trays 110 (i.e., bracket 80, tray 90, and trays 110 all comprise a conductive material such as, for example, stainless steel). This may also be accomplished by electrically connecting circuit 200 to rail 100 and/or tray 90 (i.e., a wire or other conductor connects circuit 200 to end cap 102A or 102B, electrically conductive tray 90, or electrically conductive tray 110). This may also be accomplished by electrically connecting circuit to housing 20, which is electrically connected to bracket 80, tray 90, and trays 110 (i.e., housing 20, bracket 80, tray 90, and trays 110 all comprise a conductive material such as, for example, stainless steel). As shown in FIG. 4, ions are emitted from foils 120A and 120B in the direction shown by arrow A. Gas is forced out of fluid duct 60, in the form of a fluid stream, via apertures 66 in the direction shown by arrow B. The fluid stream interacts with the emitted ions, for example, by combining with and/or forcing the ions down toward work surface or target area 2, in the direction shown by arrow C. It should be appreciated that in some embodiments, rail 100 along with alpha ionization material is replaced by or supplemented with another ion generating source such as, for example, an X-ray ion generator.

Figure 9A:
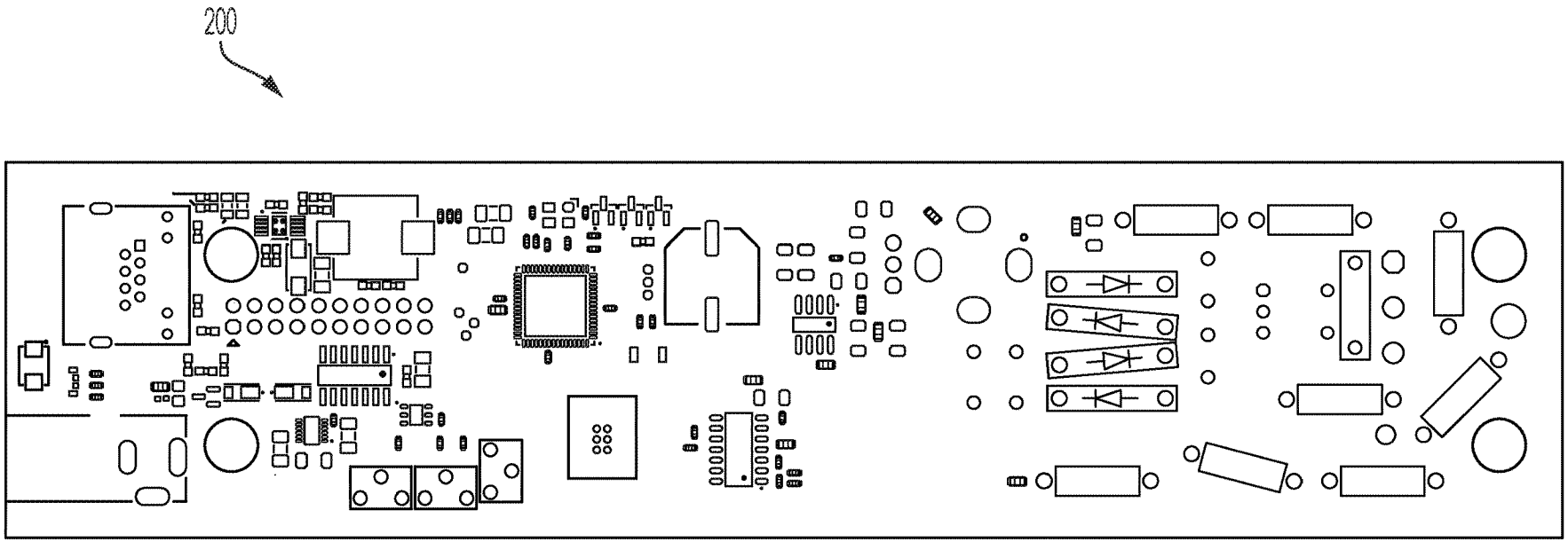
FIG. 9A is a schematic view of a circuit of the alpha ion emitter apparatus shown in FIG. 3.
Figure 9B:
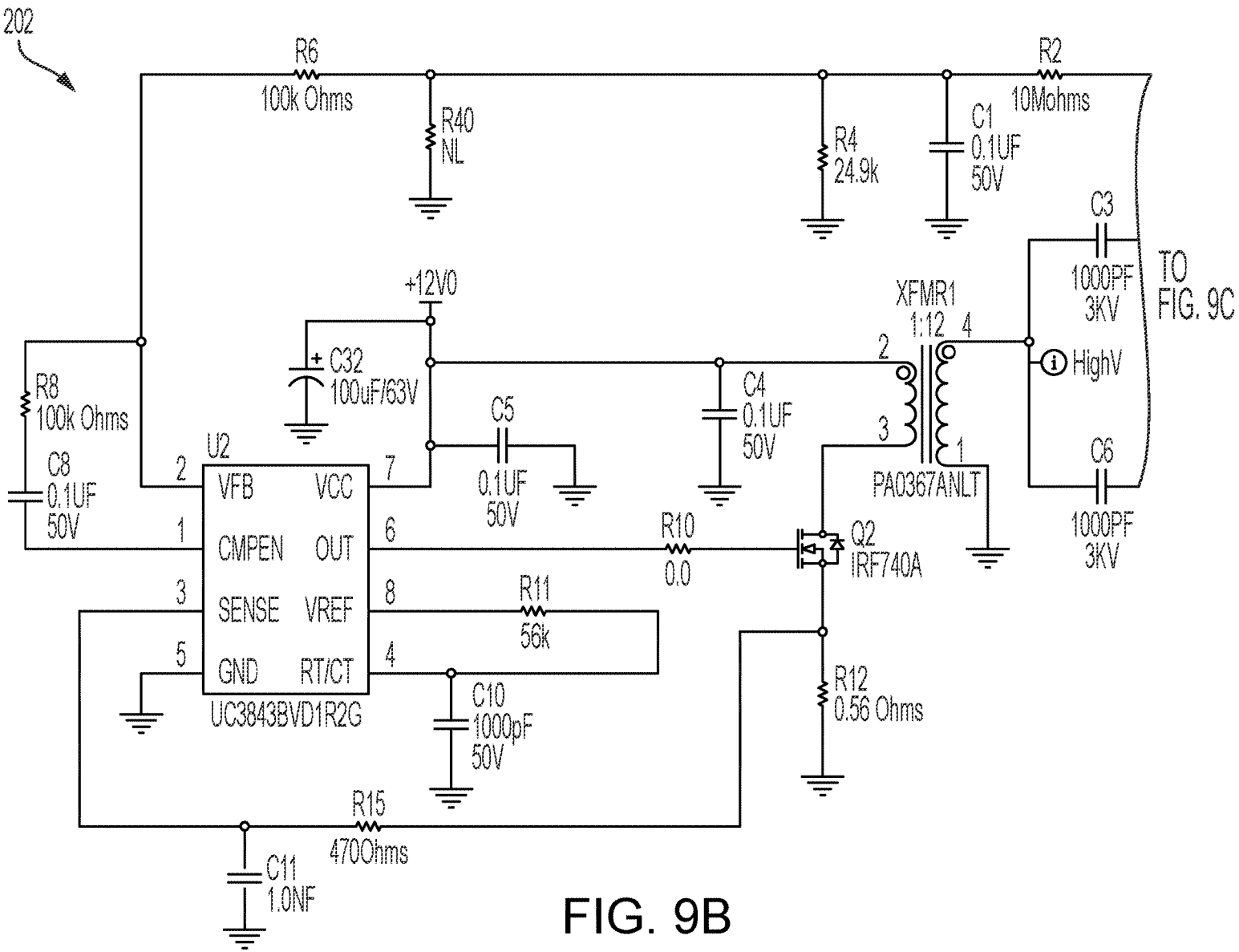
FIGS. 9B-9D illustrate a schematic view of a high voltage section of the circuit shown in FIG. 9A.
Figure 9C:
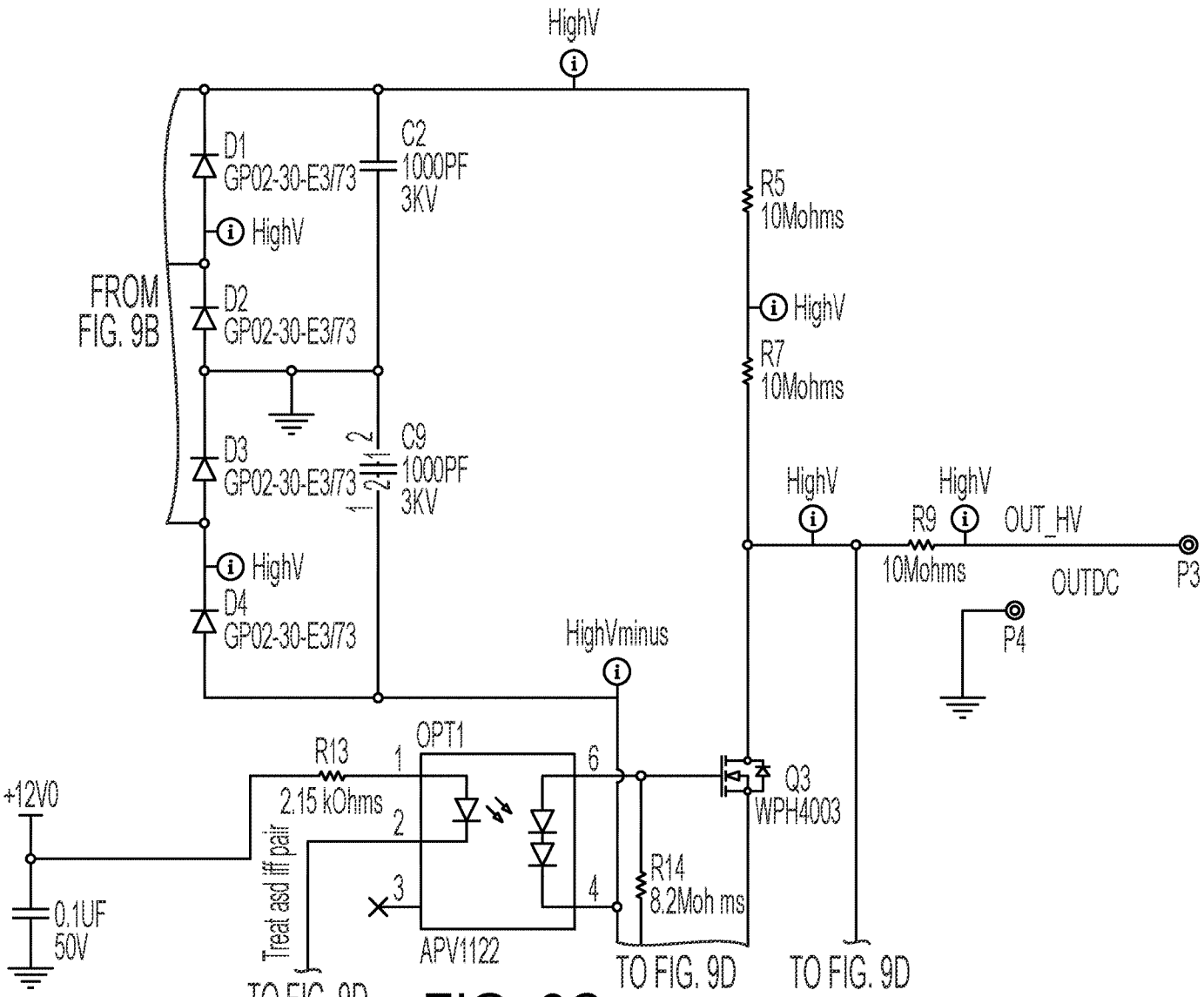
Figure 9D:
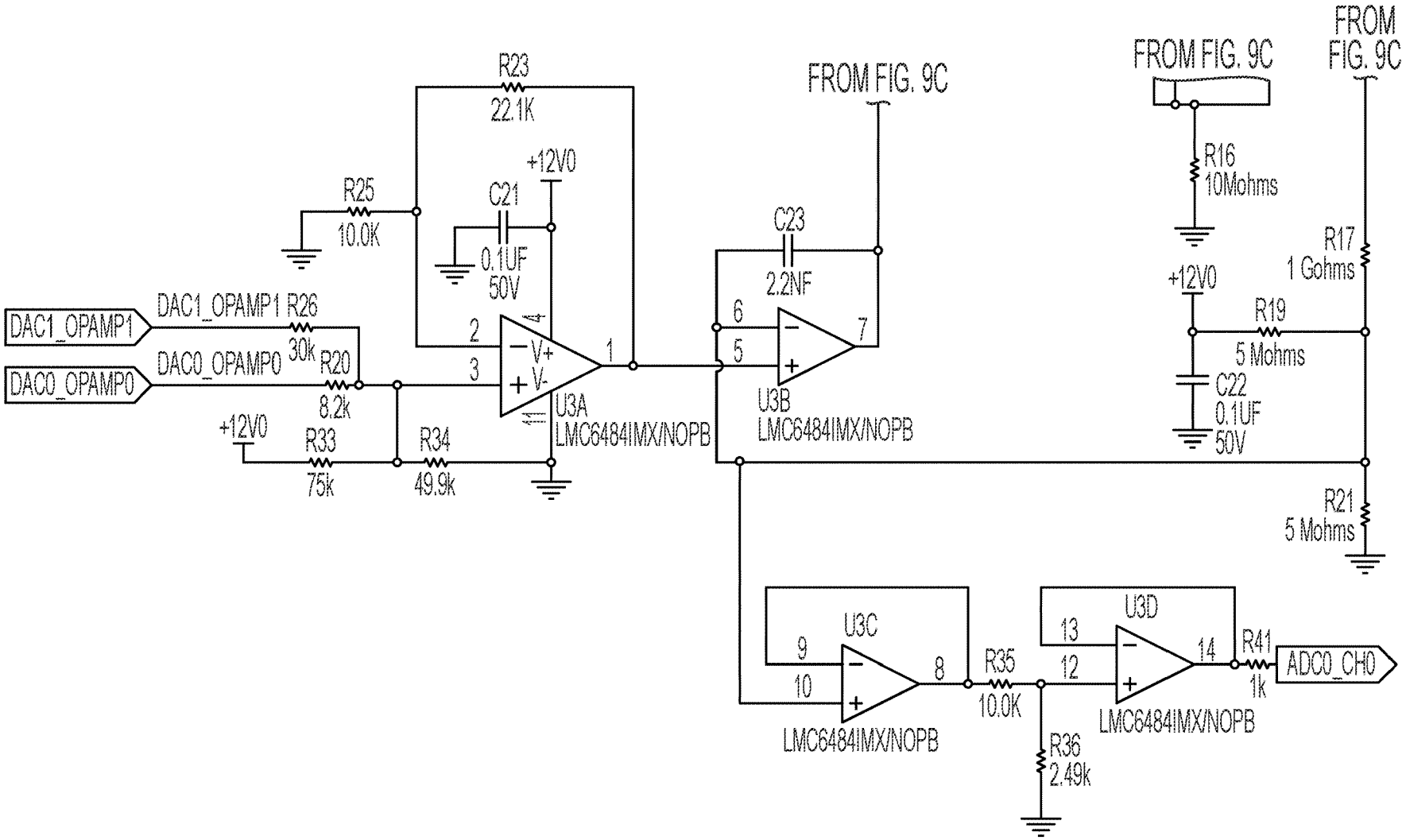
Figure 9E:
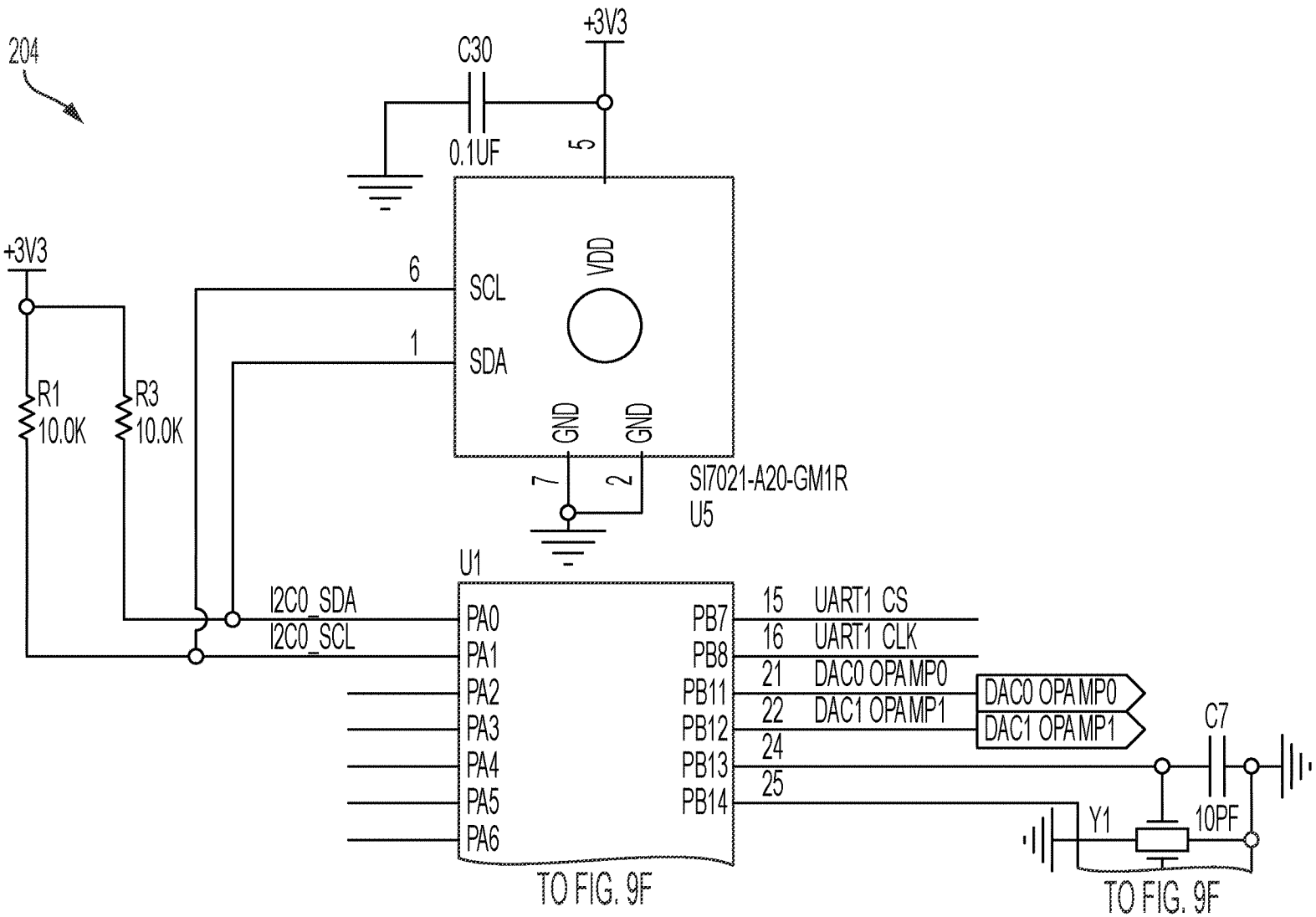
FIGS. 9E-9K illustrate a schematic view of a low voltage section of the circuit shown in FIG. 9A; and, FIG. 10 is a flow chart showing a method of producing alpha ions.
Figure 9F:
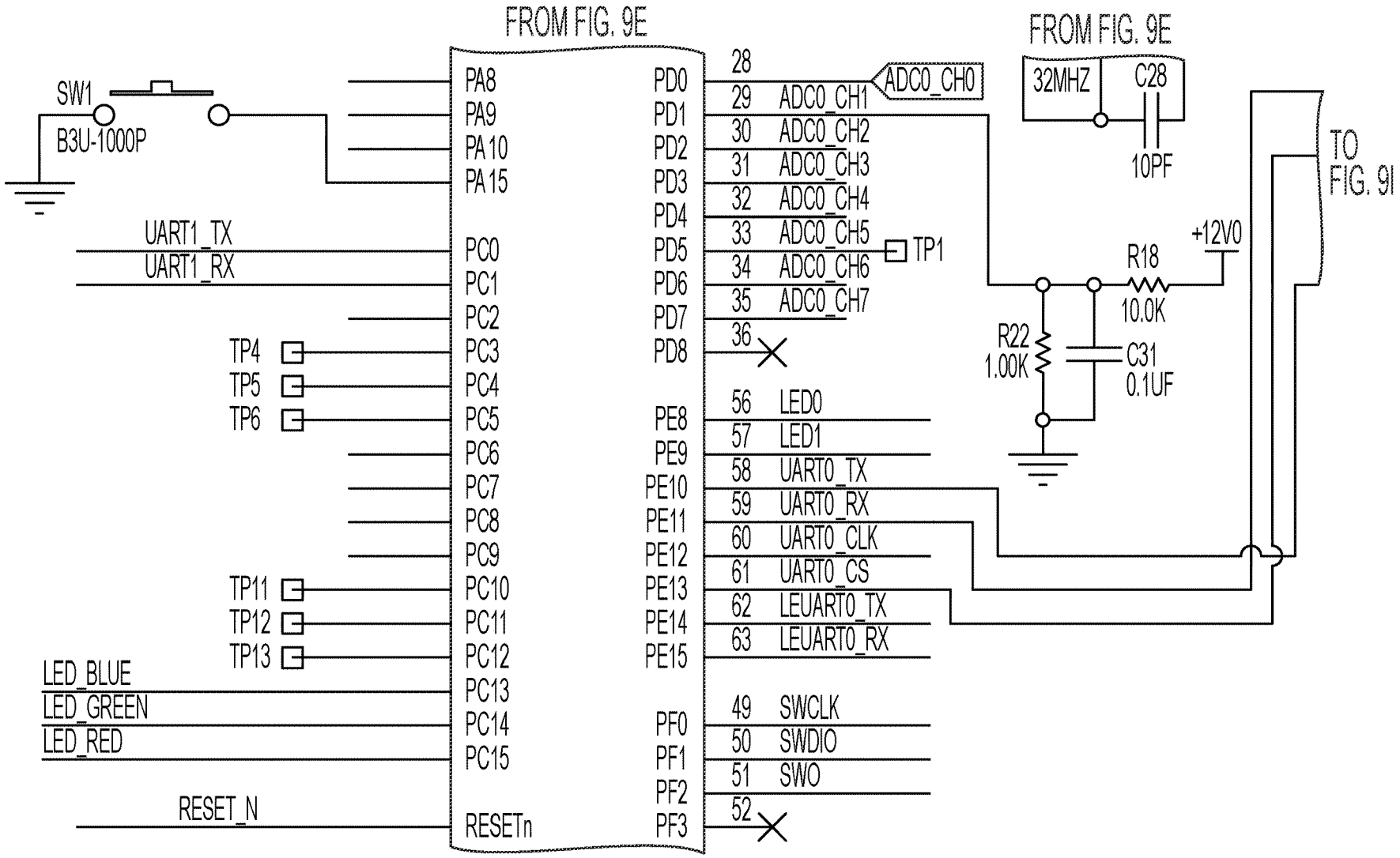
Figure 9G:
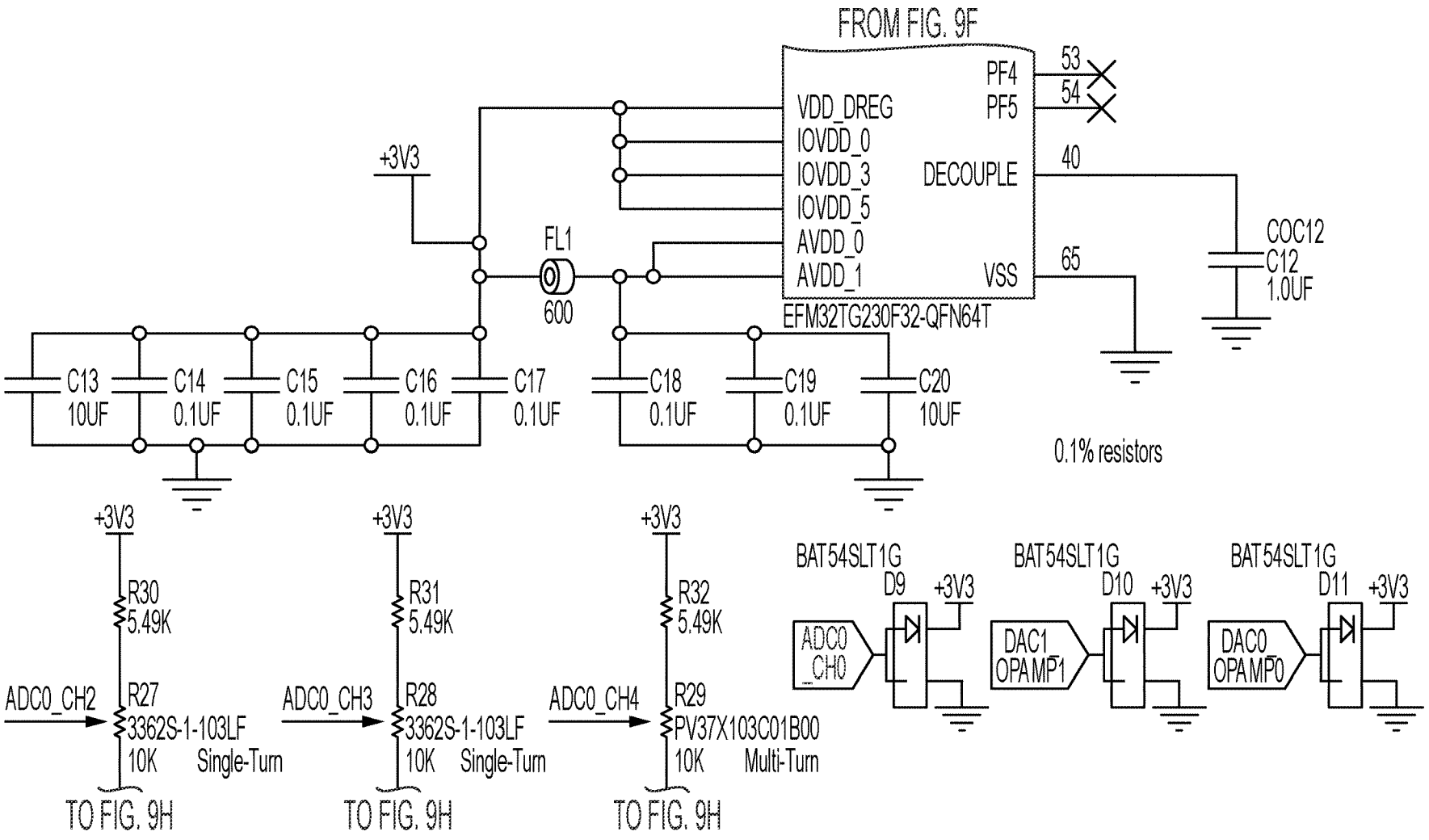
Figure 9H:
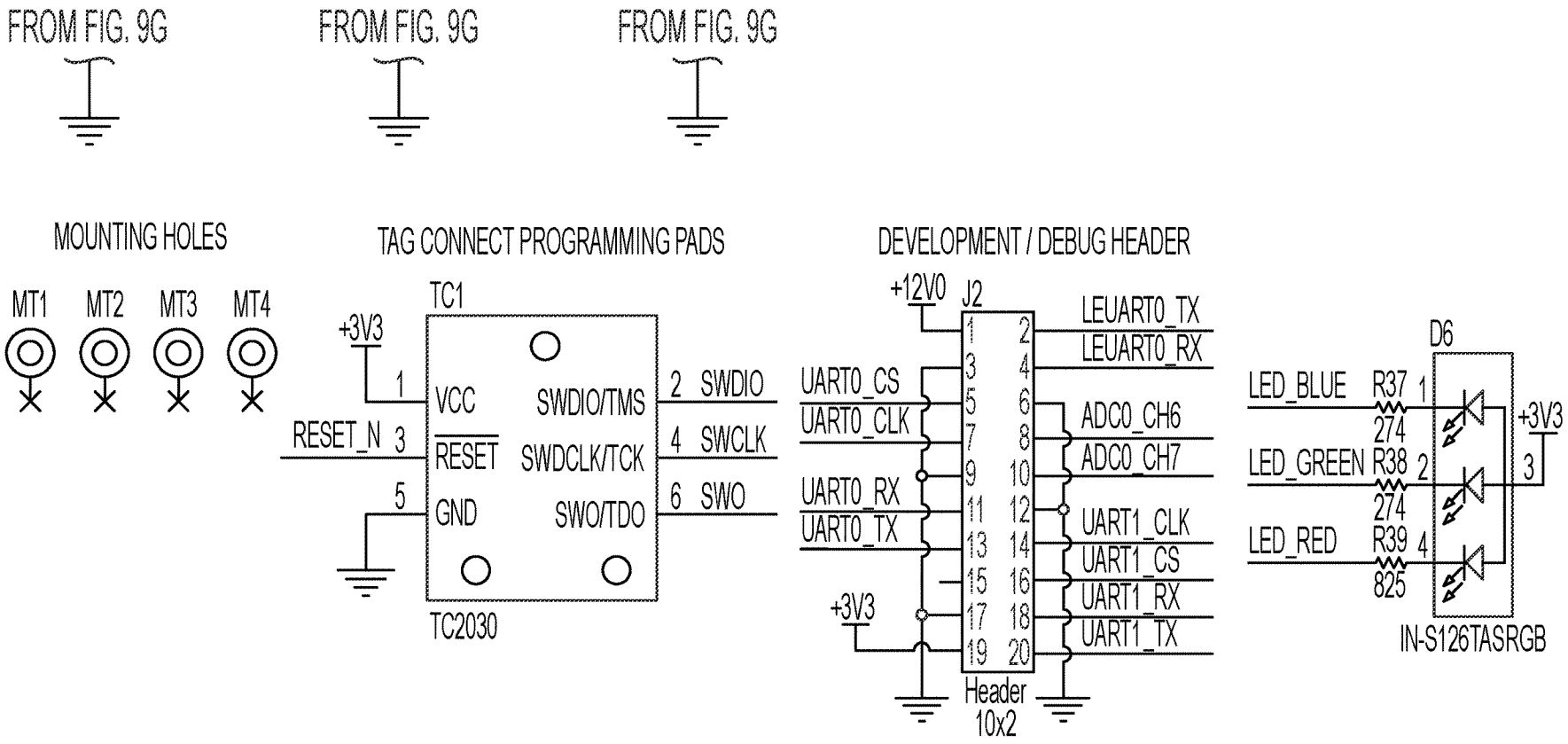
Figure 9I:
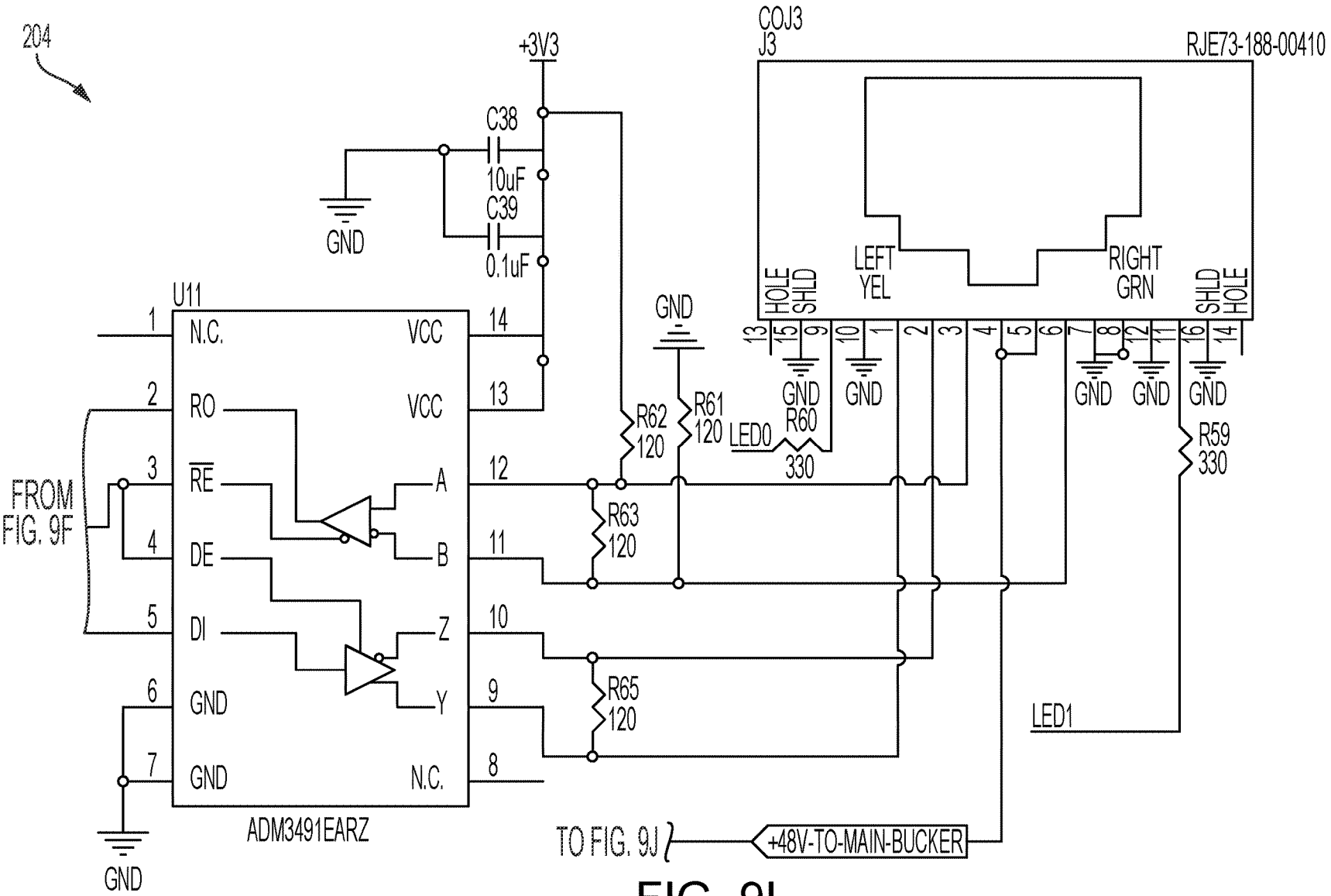
Figure 9J:
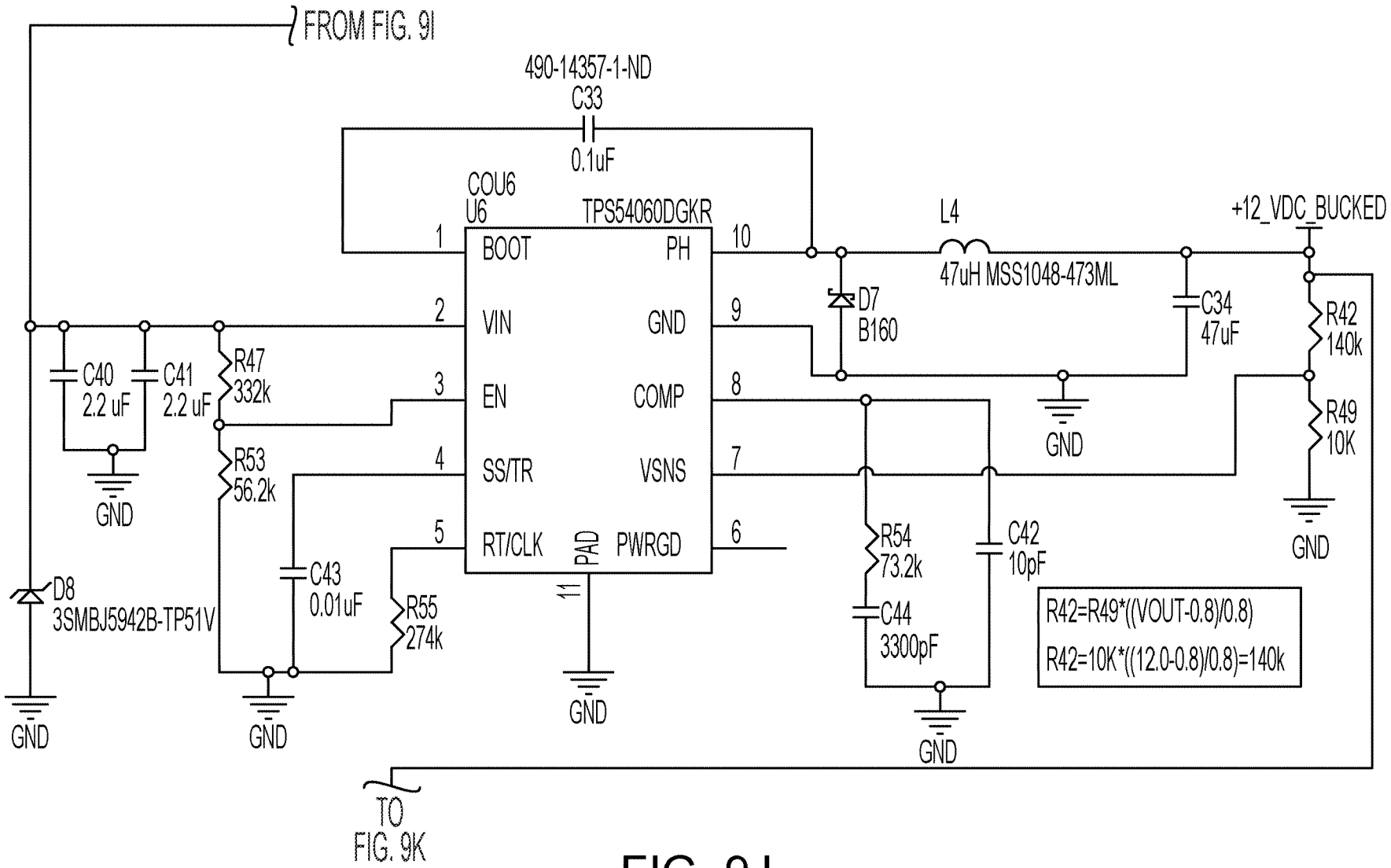
Figure 9K:
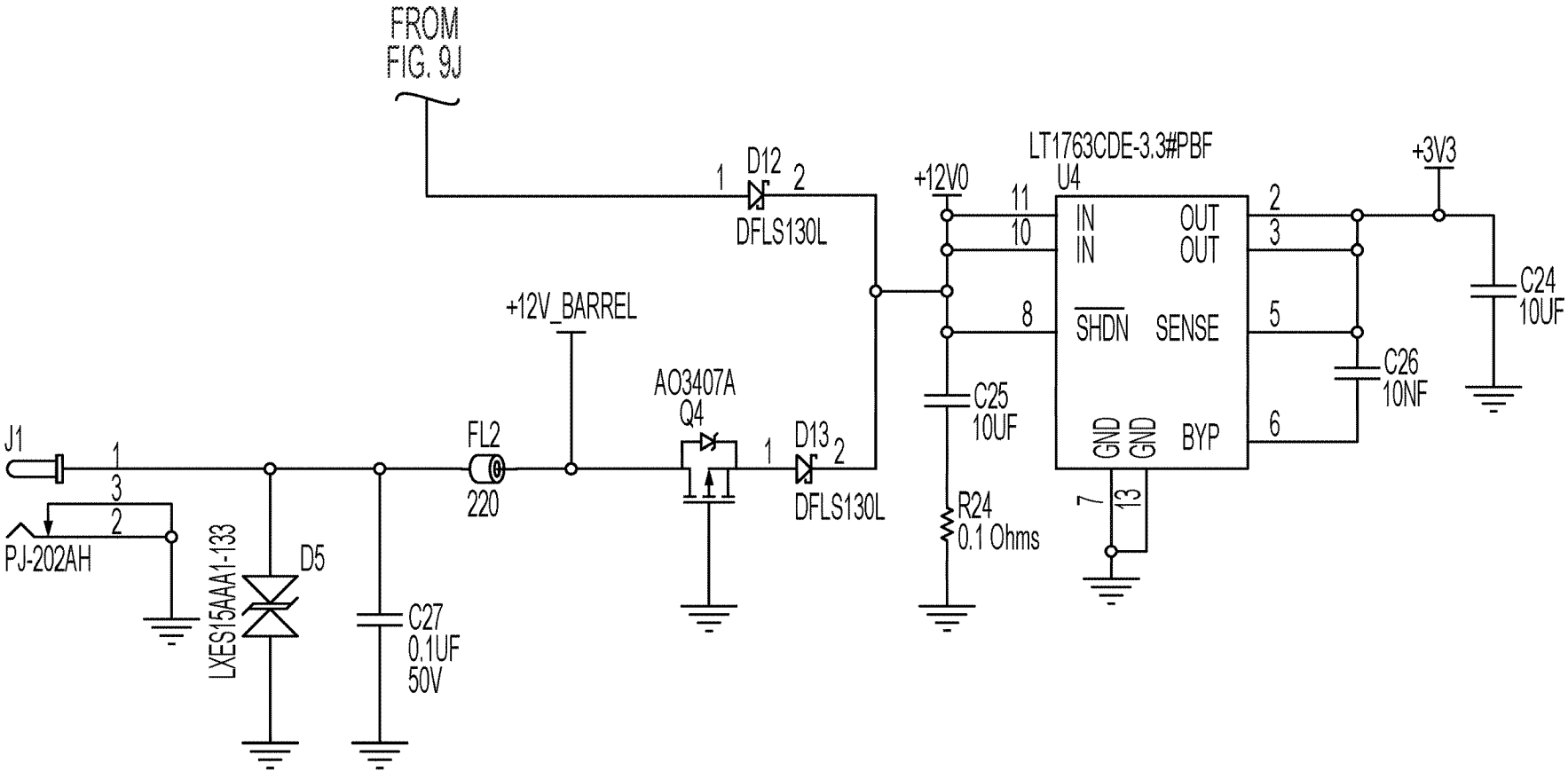

FIG. 9A is a schematic view of circuit 200. FIGS. 9B-9D illustrate a schematic view of high voltage section 202 of circuit 200. FIGS. 9E-9K show a schematic view of low voltage section 204 of circuit 200. In some embodiments, circuit 200 is a circuit board (e.g., a printed circuit board). The following description should be read in view of FIGS. 9A-9K.

Circuit 200 comprises one or more capacitors. For example, circuit 200 may comprise capacitors C1-34 and C38-44. In some embodiments, capacitors C1, C4, C5, C8, C21, C22, C27, and C29 are 0.1 uF TDK Multilayer Ceramic Capacitors (MLCCs), part number CGA3E2X7R1H104K080AA, or AVX MLCCs, part number, 06035C104K4T2A. In some embodiments, capacitor C10 is a 1000 pF capacitor. In some embodiments, capacitor C11 is a 10 nF Murata Electronics MLCC, part number GRM155R71H102KA01D, or a 10 nF Samsung Electro-Mechanics MLCC, part number CLO5B103KO5NNNC. In some embodiments, capacitor C12 is a 0.1 uF Murata Electronics MLCC, part number GRM188R61C105KA93D, or a 0.1 uF Samsung Electro-Mechanics MLCC, part number CL10A105KB8NNNC. In some embodiments, capacitors C13, C20, C24, and C25 are 10 uF Murata MLCCs, part number GRM31CR61E106MA12L or GRT31CR61H106KE01L. In some embodiments, capacitors C14, C15, C16, C17, C18, C19, C30, and C31 are 0.1 uF Murata MLCCs, part number GRM155R71C104KA88D. In some embodiments, capacitors C2, C3, C6, and C9 are 1,000 pF Kemet MLCCs, part number C330C102JHR5HA. In some embodiments, capacitor C23 is a 2.2 nF Murata MLCC, part number GRM155R71H222KA01D, or a 2.2 nF AVX MLCC, part number 04025C222JAT2A. In some embodiments, capacitor C26 is a 10 nF Murata Electronics MLCC, part number GRM155R71H103KA88D, or a 10 nF Samsung Electro-Mechanics MLCC, part number CLO5B103KB5NFNC. In some embodiments, capacitor C32 is a 100 uF Panasonic Aluminum Electrolytic Capacitor, part number EEE-1JA101P. In some embodiments, capacitors C33 and C39 are 0.1 uF Murata Electronics MLCCs, part number GCM188R71H104JA57D. In some embodiments, capacitor C34 is a 47 uF Murata Electronics MLCC, part number GRT31CR61A476KE13L. In some embodiments, capacitor C38 is a 10 uF Murata Electronics MLCC, part number GCJ31CR71A106KA13L, or a 10 uF Murata Electronics MLCC, part number GRM31MR61A106KE19L. In some embodiments, capacitors C40 and C41 are 2.2 uF Murata Electronics MLCCs, part number GRM219R61H225KE15D, or 2.2 uF Samsung Electro-Mechanics MLCCs, part number CL21A225KBFNNNE. In some embodiments, capacitor C42 is a 10 pF Murata Electronics MLCCs, part number GRM1885C1H100JA01D, or a 10 pF Yageo MLCC, part number CC0603JRNP09BN100. In some embodiments, capacitor C43 is a 0.1 uF Murata Electronics MLCC, part number GRM188R71H103KA01D, or a 0.1 uF Samsung Electro-Mechanics MLCC, part number CL10B103KB8NNNC. In some embodiments, capacitor C44 is a 3300 uF Murata Electronics MLCCs, part number GRM1885C1H332JA01D, or a 3300 uF Yageo MLCC, part number C0603C332K2RACTU. In some embodiments, capacitors C27 and C28 are 10 pF Murata Electronics MLCCs, part number GRM1555C1H100JA01D, or 10 puF Yageo MLCCs, part number CC0402JRNP09BN100.

Circuit 200 comprises one or more diodes. For example, circuit 200 may comprise diodes D1-13. In some embodiments, diodes D1-4 are 3000V Vishay Semiconductors rectifiers, part number GP02-30-E3/73. In some embodiments, diodes D12-13 are 30V Diodes Incorporated Schottky diodes, part number DFLS130L-7. In some embodiments, diode D5 is a 15V Murata Electronics transient-voltage-suppression (TVS) diode, part number LXES15AAA1-133. In some embodiments, diode D6 is a Dialight light-emitting diode (LED), part number IN-S126TASRGB. In some embodiments, diode D7 is a 60V Diodes Incorporated Schottky diode, part number B160-13-F. In some embodiments, diodes D9-11 are 30V ON Semiconductor Schottky diodes, part number BAT54SLT1G.

Circuit 200 comprises one or more ferrite beads, for example, ferrite beads FL1 and FL2. In some embodiments, ferrite bead FL1 is a 600 Ohm Murata Electronics ferrite chip bead, part number BLM15PX601SN1D. In some embodiments, ferrite bead FL2 is a 220 Ohm TDK ferrite chip bead, part number MPZ2012S221AT000.

Circuit 200 comprises one or more connectors, for example, connectors J1-3. In some embodiments, connector J1 is a CUI DC power connector, part number PJ-202AH. In some embodiments, connector J2 is a Wurth Electronics Header, part number 61302021121. In some embodiments, connector J3 is an Amphenol Commercial Products modular jack, part number RJE7318800410.

Circuit 200 comprises one or more inductors, for example, inductor L4. In some embodiments, inductor L4 is a 47 uH Coilcraft fixed inductor, part number MSS1048-473MLC.

Circuit 200 comprises one or more mounting holes, for example, mounting holes MT1-4. In some embodiments, mounting holes MT1-4 are unplated nylon holes having a 4-40 thread side.

Circuit 200 comprises one or more outputs, for example, photodiode output optocoupler OPT1. In some embodiments, photodiode output optocoupler OPT1 is a 5,000V Panasonic Industrial Devices photodiode output optocoupler, part number APV1122.

Circuit 200 comprises one or more transistors, for example, transistors Q2-4. In some embodiments, transistor Q2 is a 400V Vishay metal oxide semiconductor field effect transistor (MOSFET), part number IRF740A. In some embodiments, transistor Q3 is a 2,500V IXYS MOSFET, part number IXTH02N250. In some embodiments, transistor Q4 is a 30V Alpha & Omega Semiconductor Inc. MOSFET, part number A03407A.

Circuit 200 comprises one or more resistors, for example, resistors R1-35, R37-42, R47, R49, R53-55, R60-63, and R65. In some embodiments, resistor 33 is a 75 k Ohm resistor. In some embodiments, resistor 34 is a 49.9 k Ohm resistor. In some embodiments, resistors R1, R3, R18, R25, and R35 are 10 k Ohm Vishay thick film resistors, part number CRCW040210KOFKED. In some embodiments, resistor R36 is a 2.9 k Ohm resistor. In some embodiments, resistor R10 is a zero Ohm Yageo resistor, part number RC1206JR-070RL. In some embodiments, resistor R11 is a 56 k Ohm resistor. In some embodiments, resistor R12 is a 0.56 Ohm Yageo resistor, part number RC1206FR-071KL. In some embodiments, resistor R13 is a 2.15 k Ohm Yageo resistor, part number RC1206FR-072K15L. In some embodiments, resistor R14 is an 8.2M Ohm Yageo resistor, part number HVR3700008204FR500. In some embodiments, resistor R15 is a 470 Ohm Yageo resistor, part number RC1206FR-07470RL. In some embodiments, resistor R17 is a 1G Ohm Ohmite thick film resistor, part number MOX-300001007FE. In some embodiments, resistors R2, R5, R7, R9, and R16 are 10M Ohm Yageo metal film resistors, part number HHV-50FR-52-10M. In some embodiments, resistor R20 is an 8.2 k Ohm resistor. In some embodiments, resistors R19 and R21 are 5M Ohm Vishay metal film resistors, part number CMF555M0000FKEK. In some embodiments, resistor R22 is a 1 k Ohm Vishay thick film resistor. In some embodiments, resistor R23 is a 1 k Ohm Vishay thick film resistor, part number CRCW040222K1FKED In some embodiments, resistor R24 is a 0.1 Ohm Yageo resistor, part number PT1206FR-070R1L. In some embodiments, resistor R26 is a 30 k Ohm resistor. In some embodiments, resistors R27 and R28 are 10 k Ohm Bourns trimmer resistors, part number 3362S-1-103LF. In some embodiments, resistor R29 is a 10 k Ohm Bourns trimmer resistor, part number PV37X103C01B00. In some embodiments, resistors R30-32 are 5.49 k Ohm Vishay thick film resistors, part number CRCW04025K49FKED. In some embodiments, resistors R37-38 are 274 Ohm Vishay thick film resistors, part number CRCW0402274RFKED In some embodiments, resistor R39 is an 825 Ohm Vishay thick film resistor, part number CRCW0402825RFKED. In some embodiments, resistor R4 is a 24.9 k Ohm Yageo thick film resistor, part number RC1206FR-0730K9L. In some embodiments, resistor R41 is a 1 k Ohm resistor. In some embodiments, resistor R42 is a 140 k Ohm resistor. In some embodiments, resistor R47 is a 332 k Ohm resistor. In some embodiments, resistor R49 is a 10 k Ohm resistor. In some embodiments, resistor R53 is a 56.2 k Ohm resistor. In some embodiments, resistor R54 is a 73.2 k Ohm Panasonic thick film resistor, part number ERJ-3EKF7322V. In some embodiments, resistor R55 is a 274 k Ohm Panasonic thick film resistor, part number ERJ-3EKF2743V. In some embodiments, resistors R59 and R60 are 330 Ohm Yageo resistors, part number RC0603FR-07330RL. In some embodiments, resistors R6 and R8 are 100K Ohm Yageo resistors, part number RC0603FR-07100KL. In some embodiments, resistors R61-63 and R65 are 120 Ohm Panasonic resistors, part number ERJ-3EKF1200V.

Circuit 200 comprises one or more switch, for example, tactile switch SW1. In some embodiments, tactile switch SW1 is an Omron Electronics tactile switch, part number B3U-1000P.

Circuit 200 comprises one or more connector pads, for example, adapter cable/programming pad TC1. In some embodiments, adapter cable/programming pad TC1 is a Tag-Connect LLC adapter cable, part number TC2030-CTX.

Circuit 200 comprises one or more microcontrollers, for example, microcontroller U1. In some embodiments, microcontroller U1 is a 32-bit 32 kB Silicon Labs ARM microcontroller, part number EFM32TG230F32-QFN64.

Circuit 200 comprises one or more controllers, for example, switching controller U2. In some embodiments, switching controller U2 is an ON Semiconductor switching controller, part number UC3843BVD1R2G.

Circuit 200 comprises one or more amplifiers, for example, operational amplifier U3. In some embodiments, operational amplifier U3 is a Texas Instruments operational amplifier, part number LMC6484IMX/NOPB.

Circuit 200 comprises one or more accelerators, for example, integrated circuit (IC) accelerator U4. In some embodiments, IC accelerator U4 is a Linear Technology IC accelerator, part number LTC4313CMS8-3 #PBF.

Circuit 200 comprises one or more sensors, for example, humidity/temperature sensor U5. In some embodiments, humidity/temperature sensor U5 is a Silicon Labs humidity and temperature sensor, part number SI7021-A20-GM1R.

Circuit 200 comprises one or more regulators, for example, switching voltage regulator U6. In some embodiments, switching voltage regulator U6 is a Texas Instruments switching voltage regulator, part number TPS54060DGQ.

Circuit 200 comprises one or more IC interface, for example, IC interface U11. In some embodiments, IC interface U11 is a 3.3V Analog Devices Interface IC, part number ADM3491EARZ.

Circuit 200 comprises one or more pulse transformers, for example, pulse transformer XFMR1. In some embodiments, pulse transformer XFMR1 is an 18 uH Pulse Electronics pulse transformer, part number PA0367ANLT.

Circuit 200 comprises one or more crystals, for example, crystal Y1. In some embodiments, crystal Y1 is a 32 MHz TXC Corporation crystal, part number 7M-32.000MEEQ-T.

Circuit 200 is operatively arranged to receive an input signal, convert it, and output a signal. In some embodiments, the output signal is in the form of a sine wave variable in amplitude and DC offset. In some embodiments, the output signal is in the form of an asymmetric sine wave variable in amplitude. In some embodiments, the output signal is in the form of a symmetric sine wave variable in amplitude. In some embodiments, circuit 200 receives a 12V DC input signal and converts it to a simulated alternating current (AC) signal. Circuit 200 amplifies the AC signal or simulated AC signal using a transformer. Circuit 200 then rectifies and multiplies the simulated AC signal to create a rectified DC output that alternates polarities at high voltages. This DC output that alternates polarities is applied to rail 100. In some embodiments, circuit 200 receives an input signal of 24V and 60 Hz via connector it Circuit 200 then changes or converts the input signal and outputs an asymmetric or symmetric sine wave variable in amplitude (peak), (e.g., between 400V to 1,000V), and having a variable frequency range of 1-10 Hz, or 2-10 Hz. In some embodiments, circuit 200 converts the input signal and outputs an asymmetric or symmetric sine wave variable in amplitude (peak to peak) between 400V to 2,400V, and having a variable frequency range of 1-10 Hz, or 2-10 Hz. The output signal, now in the form of an asymmetric or symmetric sine wave, is applied to rail 100. In some embodiments, the output signal is applied to housing 20, bracket 80, tray 90, and/or rail 100.

The ionization material (e.g., Polonium-210) arranged in rail 100 emits high energy alpha particles. The high energy alpha particles strip electrons off of air molecules to create both positive and negative ions. The electrified rail 100 (and/or housing 20, bracket 80, tray 90), when in a positive cycle of the sine wave output signal, repels the positive ions. The electrified rail 100 (and/or housing 20, bracket 80, tray 90), when in a negative cycle, repels the negative ions. The collaboration of repelling the ions from the electrified rail 100 and the air streams from fluid duct 60 in direction B causes the ions to travel further than any known device toward work surface 2 (see FIG. 5).

The ion emitter apparatus of the present disclosure utilizes a principle that ion formation is a function of distance from the alpha ion emitter source. There is a distance from the alpha ion emitter source at which ion formation reaches a maximum (i.e., the optimized distance). Ion density in the vicinity of the optimized distance is at a maximum. Ions in the vicinity of the optimized distance comprise both positive and negative ions. If left alone, ions in the vicinity of the optimized distance will eventually and substantially recombine with each other and will, therefore, be unable to provide the desired benefit at the work surface. Thus, reducing the probability of local recombination of positive and negative ions is critical to an ion emitter system. Thus, alpha ion emitter apparatus 10 is specifically designed to place its various elements at the optimized distance to increase the probability to maximize ion deliver to the work surface, as discussed below.

First, alpha ion emitter apparatus 10 comprises an electric field concentration structure (i.e., housing 20, fluid duct 60, bracket 80, and/or rail 100) which sorts positive ions from negative ions, thereby reducing localized recombination. Ions of opposite polarity, with respect to the concentration structure, will be attracted to the concentration structure. Ions of like polarity, with respect to the concentration structure, will be repelled from the structure. Ideally, ions of like polarity will be directed toward the air (or gas) flow structure.

Second, alpha ion emitter apparatus 10 comprises a structure that directs air or gas from the local vicinity of sorting toward the work surface (i.e., gas flow structure). This gas flow will assist in the directing of ions of like polarity toward the work surface, so that they can provide the desired benefit at the work surface.

The electric field concentration structure and the gas flow structure may be combined into a single structure that performs both functions (i.e., air duct 60 and ionization material 120A-B). Air duct 60 is operatively arranged at the optimized distance from ionization material 120A-B to optimize delivery of ions to work surface 2.

Figure 10:
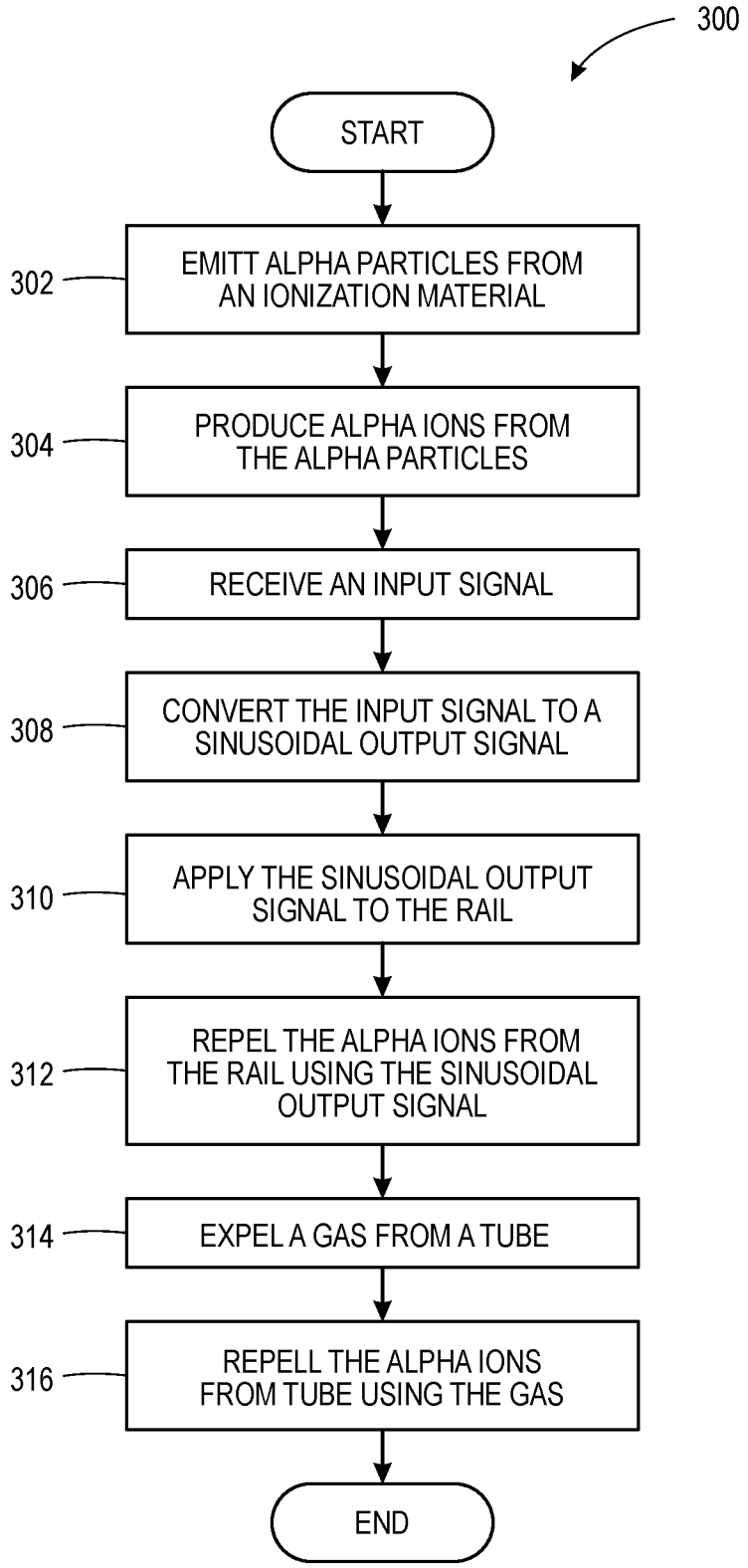

FIG. 10 depicts flow chart 300 showing a method of producing alpha ions using an alpha ion emitter, for example, alpha ion emitter apparatus 10.

In step 302, alpha ion emitter apparatus 10 emits alpha particles, for example, via ionization material 120A-B.

In step 304, the alpha particles remove ions from air molecules to create alpha ions. Ionization material 120A-B creates high intensity alpha particles that interact with air molecules to create both positive and negative ions.

In step 306, circuit 200 receives an input signal. As previously discussed, in some embodiments the input signal may be a 12V DC input signal or a 24V DC input signal. It should be appreciated that an input signal with any suitable voltage may be used.

In step 308, circuit 200 converts the input signal to a sinusoidal output signal. As previously described, the output signal may be symmetric or asymmetric. In some embodiments, circuit 200 converts the DC input signal to a simulated AC signal, amplifies the simulated AC signal using a transformer, and rectifies and multiplies the simulated AC signal to create a rectified DC output that alternates polarities at high voltages. This DC output that alternates polarities is applied to bracket 80.

In step 310, circuit 200 applies the sinusoidal output signal to rail 100. In some embodiments, circuit 200 applies the sinusoidal output signal to rail 100 using any suitable means, such as a wire, cable, etc.

In step 312, alpha ion emitter apparatus 10 repels the alpha ions from rail 100 using the sinusoidal output signal, for example, in direction A. For example, during the positive cycle of the sinusoidal output signal, the positive ions are repelled from rail 100. In the negative cycle of the sinusoidal output signal, the negative ions are repelled from rail 100.

In step 314, gas is expelled from fluid duct 60. Specifically, gas enters fluid duct 60 via connector 68 and is forced out of one or more apertures 66 therein.

In step 316, the gas being expelled from the one or more apertures 66 repels the alpha ions from fluid duct 60, for example, in direction B.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

2 Work surface

10 Alpha ion emitter apparatus

20 Housing
22 Surface
24 Groove
26 Groove
28 End
30 End
32 Window
34 Hole
36 Hole
38 Channel
40 End plate
42 Channel
50 Guard
52 End
54 End
56 Channel
58 Channel
60 Fluid duct
62 End
64 End
66 Apertures
68 Connector
70 Plug
72A Bracket
72B Bracket
80 Bracket
82 Edge
84 Edge
86 Surface
88 Surface
90 Tray
92 Channel
94 Channel
100 Rail
102A End cap
102B End cap
104A Section
104B Section
104C Section
104D Section
104E Section
104F Section
110 Tray
112 Cavity
114 Channel
116 Channel
120A Foil or ionization material
120B Foil or ionization material
122 Label
130 Grid
200 Circuit
202 Section
204 Section
300 Flow chart
302 Step
304 Step
306 Step
308 Step
310 Step
314 Step
316 Step
A Arrow
B Arrow
C Arrow
C1 Capacitor
C2 Capacitor
C3 Capacitor
C4 Capacitor
C5 Capacitor
C6 Capacitor
C7 Capacitor
C8 Capacitor
C9 Capacitor
C10 Capacitor
C11 Capacitor
C12 Capacitor
C13 Capacitor
C14 Capacitor
C15 Capacitor
C16 Capacitor
C17 Capacitor
C18 Capacitor
C19 Capacitor
C20 Capacitor
C21 Capacitor
C22 Capacitor
C23 Capacitor
C24 Capacitor
C25 Capacitor
C26 Capacitor
C27 Capacitor
C28 Capacitor
C29 Capacitor
C30 Capacitor
C31 Capacitor
C32 Capacitor
C33 Capacitor
C34 Capacitor
C38 Capacitor
C39 Capacitor
C40 Capacitor
C41 Capacitor
C42 Capacitor
C43 Capacitor
C44 Capacitor
D1 Diode
D2 Diode
D3 Diode
D4 Diode
D5 Diode
D6 Diode
D7 Diode
D8 Diode
D9 Diode
D10 Diode
D1*l* Diode
D12 Diode
D13 Diode
FL1 Ferrite bead
FL2 Ferrite bead
J1 Connector
J2 Deployment/debug header
J3 Connector
L4 Inductor
MT1 Mounting hole
MT2 Mounting hole
MT3 Mounting hole
MT4 Mounting hole
OPT1 Photodiode output optocoupler
Q2 Metal oxide semiconductor field effect transistor (MOSFET)
Q3 Metal oxide semiconductor field effect transistor (MOSFET)

Q4 Metal oxide semiconductor field effect transistor (MOSFET)
R1 Resistor
R2 Resistor
R3 Resistor
R4 Resistor
R5 Resistor
R6 Resistor
R7 Resistor
R8 Resistor
R9 Resistor
R10 Resistor
R11 Resistor
R12 Resistor
R13 Resistor
R14 Resistor
R15 Resistor
R16 Resistor
R17 Resistor
R18 Resistor
R19 Resistor
R20 Resistor
R21 Resistor
R22 Resistor
R23 Resistor
R24 Resistor
R25 Resistor
R26 Resistor
R27 Resistor
R28 Resistor
R29 Resistor
R30 Resistor
R31 Resistor
R32 Resistor
R33 Resistor
R34 Resistor
R35 Resistor
R37 Resistor
R38 Resistor
R39 Resistor
R40 Resistor
R41 Resistor
R42 Resistor
R47 Resistor
R49 Resistor
R53 Resistor
R54 Resistor
R55 Resistor
R59 Resistor
R60 Resistor
R61 Resistor
R62 Resistor
R63 Resistor
R65 Resistor
SW1 Tactile switch
TC1 Adapter cable/programming pad
U1 Microcontroller
U2 Switching controller
U3 Operational amplifier
U4 Integrated circuit (IC) accelerator
U5 Humidity/temperature sensor
U6 Switching voltage regulator
U11 Integrated circuit (IC) interface
XFMR1 Pulse transformer
Y1 Crystal

What is claimed is:

1. An alpha ion emitter apparatus, comprising:
a circuit;
a fluid duct including one or more apertures; and,
a rail electrically connected to the circuit and operatively arranged to hold an alpha ionization material that emits alpha particles, the alpha particles creating alpha ions;
wherein the circuit is operatively arranged to apply a sinusoidal output signal to at least one of the fluid duct and the rail.

2. The alpha ion emitter apparatus as recited in claim 1, wherein the fluid duct is operatively arranged to expel gas through the one or more apertures to repel the alpha ions in a first direction.

3. The alpha ion emitter apparatus as recited in claim 1, wherein the sinusoidal output signal is asymmetric.

4. The alpha ion emitter apparatus as recited in claim 1, wherein the sinusoidal output signal is symmetric.

5. The alpha ion emitter apparatus as recited in claim 1, wherein the output signal applied to the at least one of the fluid duct and the rail is operatively arranged to repel the alpha ions in a second direction.

6. The alpha ion emitter apparatus as recited in claim 1, further comprising a bracket, wherein the circuit, the fluid duct, and the rail are connected to the bracket.

7. The alpha ion emitter apparatus as recited in claim 6, wherein the bracket comprises:
a first surface, the fluid duct being connected to the first surface; and,
a second surface arranged substantially perpendicular to the first surface, the rail being connected to the second surface.

8. The alpha ion emitter apparatus as recited in claim 6, wherein the bracket and the rail comprise an electrically conductive metal.

9. The alpha ion emitter apparatus as recited in claim 1, wherein the circuit is operatively arranged to:
receive an input signal; and,
convert the input signal to the sinusoidal output signal.

10. The alpha ion emitter apparatus as recited in claim 1, wherein the alpha ionization material comprises Polonium-210.

11. The alpha ion emitter apparatus as recited in claim 1, wherein:
the charged fluid duct and/or rail is operatively arranged to repel the alpha ions;
the fluid duct expels gas to repel the alpha ions; and,
the alpha ions are directed toward a work surface.

12. A method of producing alpha particles using an alpha ion emitter apparatus, the alpha ion emitter apparatus comprising a circuit, a fluid duct including one or more apertures, and a rail including an alpha ionization material, the method comprising:
emitting, using the alpha ionization material, a plurality of alpha particles;
producing, using the alpha particles, a plurality of alpha ions;
applying, using the circuit, a sinusoidal output signal to at least one of the fluid duct and the rail; and,
repelling, using the at least one of the fluid duct and the rail, the plurality of alpha ions in a first direction.

13. The method as recited in claim 12, wherein applying the sinusoidal output signal to the rail comprises:
receiving, using the circuit, an input signal;
converting, using the circuit, the input signal to the sinusoidal output signal; and, applying, using the circuit, the sinusoidal output signal to the at least one of the fluid duct and the rail.

14. The method as recited in claim 12, further comprising:

expelling, using the fluid duct, gas through the one or more apertures; and, repelling, using the gas, the alpha ions in a second direction.

15. An ion emitter apparatus, comprising:

an X-ray ion generator operatively arranged to emit ions;

at least one conductor; and, a circuit operatively arranged to apply an output signal to the at least one conductor and repel the ions.

16. The ion emitter apparatus as recited in claim 15, further comprising a fluid duct operatively arranged to expel gas and repel the ions.

17. The ion emitter apparatus as recited in claim 15, wherein the ion generator comprises a rail including an alpha ionization material.

* * * * *